US008938883B2

(12) United States Patent
Gringer et al.

(10) Patent No.: US 8,938,883 B2
(45) Date of Patent: Jan. 27, 2015

(54) CUTTING IMPLEMENTS

(75) Inventors: Donald Gringer, New York, NY (US); Yuan Fang Cheng, Forest Hills, NY (US)

(73) Assignee: Allway Tools, Inc., Bronx, NY (US)

( * ) Notice: Subject to any disclaimer, the term of this patent is extended or adjusted under 35 U.S.C. 154(b) by 614 days.

(21) Appl. No.: 13/004,084

(22) Filed: Jan. 11, 2011

(65) Prior Publication Data

US 2011/0167647 A1 Jul. 14, 2011

Related U.S. Application Data

(60) Provisional application No. 61/335,718, filed on Jan. 11, 2010.

(51) Int. Cl.
*B26B 1/04* (2006.01)
*B26B 5/00* (2006.01)

(52) U.S. Cl.
CPC ..... *B26B 1/048* (2013.01); *B26B 5/001* (2013.01)
USPC ..... 30/155; 30/156; 30/160

(58) Field of Classification Search
CPC ..... B26B 1/00; B26B 1/04; B26B 1/042; B26B 1/046; B26B 1/048; B26B 1/08
USPC ..... 30/2, 153–161
See application file for complete search history.

(56) References Cited

U.S. PATENT DOCUMENTS

| | | | | |
|---|---|---|---|---|
| 656,468 | A | 8/1900 | Mullin et al. | |
| 693,518 | A | 2/1902 | Hamilton | |
| 736,741 | A | 8/1903 | Klemm | |
| 952,746 | A | 3/1910 | Lane | |
| 1,068,683 | A | 7/1913 | Malek | |
| 1,315,901 | A | 9/1919 | Ballinger | |
| 1,353,490 | A * | 9/1920 | Pantalek | 30/160 |
| 1,452,893 | A * | 4/1923 | Porth | 30/286 |
| 1,463,745 | A | 7/1923 | Layne | |
| 1,603,914 | A | 10/1926 | Hermann | |
| 1,584,021 | A | 5/1928 | Melvin | |
| 1,864,011 | A | 6/1932 | Brown | |

(Continued)

FOREIGN PATENT DOCUMENTS

| | | |
|---|---|---|
| DE | 3520187 A1 | 12/1986 |
| GB | 2 085 789 | 5/1982 |
| WO | WO 00/06347 | 2/2000 |

OTHER PUBLICATIONS

Allway Tools, Soft Grip Tools for Hard Hat Jobs, 2008.

(Continued)

*Primary Examiner* — Jason Daniel Prone
(74) *Attorney, Agent, or Firm* — Gottlieb, Rackman & Reisman, P.C.

(57) ABSTRACT

A folding knife for applying a cutting action includes a blade assembly having a guard configured to cover the cutting edge of the blade when the knife is not in use. The guard is maintained in a normally blade covered position by a resilient member. The blade guard has a guard actuator for providing at least one motion for a user to move the blade guard from the normally blade covered position to an un-guarded or cutting position. The knife further includes an actuator for unlocking the blade assembly from the closed position to a locked open position. Upon depression of the actuator, the blade assembly will automatically open to a locked open position from a locked closed position.

8 Claims, 27 Drawing Sheets

(56) References Cited

U.S. PATENT DOCUMENTS

| | | | | |
|---|---|---|---|---|
| 2,119,045 | A | 5/1938 | Deitrich | |
| 2,145,985 | A * | 2/1939 | Krajicek | 30/294 |
| 2,245,096 | A | 6/1941 | Penney | |
| 2,276,026 | A * | 3/1942 | Davidson, Jr. | 30/154 |
| 2,286,190 | A | 6/1942 | Abrahamsen | |
| 2,336,284 | A | 12/1943 | Nelson | |
| 2,376,887 | A * | 5/1945 | Waltern | 30/125 |
| 2,730,800 | A * | 1/1956 | Bailey | 30/153 |
| 2,783,537 | A | 3/1957 | Gringer | |
| 2,846,764 | A * | 8/1958 | Hyneman | 30/172 |
| 2,862,296 | A | 12/1958 | Anderson | |
| 2,948,961 | A | 8/1960 | Ortner | |
| 3,107,426 | A | 10/1963 | Robinson, Jr. | |
| 3,132,371 | A | 5/1964 | Enos et al. | |
| 3,162,947 | A | 12/1964 | Gringer | |
| 3,192,624 | A | 7/1965 | Gringer | |
| 3,250,000 | A | 5/1966 | Schumman | |
| 3,577,637 | A | 5/1971 | Braginetz | |
| 3,667,122 | A | 6/1972 | Black | |
| 3,688,401 | A | 9/1972 | Hartman | |
| 3,781,988 | A * | 1/1974 | Jones | 30/2 |
| 3,879,847 | A | 4/1975 | Roll | |
| 3,892,039 | A | 7/1975 | Fisher | |
| 3,906,627 | A | 9/1975 | Manning | |
| D240,699 | S | 7/1976 | Gerson | |
| 4,005,525 | A | 2/1977 | Gringer | |
| 4,086,698 | A * | 5/1978 | Sparks | 30/2 |
| 4,091,537 | A * | 5/1978 | Stevenson, Jr. | 30/151 |
| 4,103,421 | A | 8/1978 | Quenot | |
| 4,139,939 | A | 2/1979 | Crooks | |
| 4,200,977 | A | 5/1980 | Kageyama et al. | |
| 4,242,795 | A | 1/1981 | Rollband et al. | |
| D267,826 | S | 2/1983 | Gringer | |
| D274,952 | S | 7/1984 | Gringer | |
| D274,953 | S | 7/1984 | Gringer | |
| 4,558,517 | A | 12/1985 | Gringer | |
| D282,881 | S | 3/1986 | Gringer | |
| 4,587,735 | A * | 5/1986 | Walters et al. | 30/153 |
| 4,621,425 | A | 11/1986 | Stoutenberg | |
| 4,660,284 | A * | 4/1987 | Decarolis | 30/157 |
| 4,805,304 | A | 2/1989 | Knoop | |
| 4,817,284 | A | 4/1989 | Sacherman et al. | |
| 4,835,865 | A | 6/1989 | Knoop | |
| 4,987,682 | A * | 1/1991 | Minnick | 30/295 |
| D314,696 | S | 2/1991 | Lucrelli | |
| 5,012,581 | A | 5/1991 | Fletcher et al. | |
| 5,022,156 | A | 6/1991 | Kallens et al. | |
| 5,025,558 | A | 6/1991 | Gilbert | |
| 5,031,322 | A | 7/1991 | Jacoff | |
| D319,378 | S | 8/1991 | Wilcox | |
| 5,036,591 | A | 8/1991 | Cousins | |
| 5,056,226 | A | 10/1991 | Gringer | |
| D326,546 | S | 5/1992 | Gringer | |
| 5,121,544 | A | 6/1992 | Gilbert | |
| 5,141,517 | A | 8/1992 | Shutt | |
| 5,164,871 | A | 11/1992 | Hughes et al. | |
| D332,901 | S | 2/1993 | Campbell | |
| 5,241,750 | A * | 9/1993 | Chomiak | 30/2 |
| 5,289,637 | A | 3/1994 | Coffey | |
| 5,293,791 | A * | 3/1994 | Allen et al. | 30/90.4 |
| D346,319 | S | 4/1994 | Lavallee et al. | |
| 5,299,355 | A | 4/1994 | Boda et al. | |
| 5,330,494 | A * | 7/1994 | van der Westhuizen et al. | 30/151 |
| 5,386,632 | A | 2/1995 | Shmidt | |
| 5,400,509 | A | 3/1995 | Collins | |
| RE34,979 | E | 6/1995 | Gringer | |
| 5,426,855 | A | 6/1995 | Keklak et al. | |
| 5,433,004 | A | 7/1995 | Thompson et al. | |
| 5,435,064 | A | 7/1995 | Brookfield | |
| D364,252 | S | 11/1995 | Henke | |
| 5,481,804 | A | 1/1996 | Platts | |
| 5,495,673 | A | 3/1996 | Gardiner et al. | |
| 5,528,832 | A | 6/1996 | Schmidt | |
| 5,528,834 | A | 6/1996 | Seber et al. | |
| 5,545,175 | A | 8/1996 | Abidin et al. | |
| 5,581,890 | A | 12/1996 | Schmidt | |
| 5,581,893 | A * | 12/1996 | Ouellette | 30/286 |
| 5,613,300 | A | 3/1997 | Schmidt | |
| 5,621,973 | A | 4/1997 | Seber et al. | |
| 5,694,692 | A | 12/1997 | Reinschreiber | |
| 5,769,094 | A | 6/1998 | Jenkins, Jr. et al. | |
| 5,806,189 | A | 9/1998 | Bailey | |
| 5,813,121 | A | 9/1998 | Gringer | |
| 5,852,874 | A * | 12/1998 | Walker | 30/2 |
| 5,878,501 | A * | 3/1999 | Owens et al. | 30/286 |
| 5,890,290 | A * | 4/1999 | Davis | 30/2 |
| D411,429 | S | 6/1999 | Gringer | |
| 5,911,761 | A | 6/1999 | Tilley | |
| 5,956,788 | A | 9/1999 | Henke | |
| D420,882 | S | 2/2000 | Majolo et al. | |
| 6,026,575 | A | 2/2000 | Wonderley | |
| 6,035,536 | A | 3/2000 | Dewberry | |
| 6,044,562 | A | 4/2000 | Dillenbeck | |
| 6,058,607 | A | 5/2000 | Gringer | |
| 6,161,290 | A | 12/2000 | Takamasa | |
| 6,178,640 | B1 * | 1/2001 | Votolato | 30/2 |
| D437,764 | S | 2/2001 | Zimmerman | |
| D439,128 | S | 3/2001 | Wass | |
| 6,219,878 | B1 | 4/2001 | Dewberry | |
| 6,219,923 | B1 | 4/2001 | Sinisi et al. | |
| 6,263,577 | B1 | 7/2001 | Wonderley | |
| 6,286,215 | B1 | 9/2001 | Panaccione | |
| 6,317,986 | B1 | 11/2001 | Huang | |
| D453,251 | S | 1/2002 | Gringer et al. | |
| 6,349,473 | B1 | 2/2002 | Schmidt | |
| 6,354,007 | B1 * | 3/2002 | Scarla | 30/156 |
| 6,415,514 | B1 | 7/2002 | Chun | |
| 6,438,849 | B1 | 8/2002 | Wonderley | |
| D463,639 | S | 9/2002 | Panfili et al. | |
| 6,453,559 | B1 * | 9/2002 | Marshall et al. | 30/2 |
| D467,395 | S | 12/2002 | McCool | |
| 6,487,778 | B1 | 12/2002 | Gringer et al. | |
| D468,989 | S | 1/2003 | Gringer et al. | |
| 6,530,098 | B1 | 3/2003 | Gringer et al. | |
| 6,568,087 | B1 | 5/2003 | Gringer | |
| 6,578,229 | B1 | 6/2003 | Dziallas et al. | |
| 6,578,266 | B2 * | 6/2003 | Chomiak | 30/2 |
| D478,493 | S | 8/2003 | Martone et al. | |
| D479,374 | S | 9/2003 | Gringer et al. | |
| D479,375 | S | 9/2003 | Gringer et al. | |
| D480,288 | S | 10/2003 | DeLillo | |
| 6,643,936 | B2 * | 11/2003 | Carlson et al. | 30/162 |
| 6,688,003 | B2 * | 2/2004 | Scarla | 30/156 |
| D489,851 | S | 5/2004 | Jones et al. | |
| 6,732,395 | B2 | 5/2004 | Gringer | |
| 6,748,659 | B1 * | 6/2004 | Street | 30/2 |
| 6,832,438 | B1 | 12/2004 | Gringer et al. | |
| 6,907,668 | B2 | 6/2005 | Polei | |
| 6,915,577 | B2 * | 7/2005 | Scala | 30/156 |
| 6,964,100 | B1 | 11/2005 | Misland et al. | |
| 6,968,622 | B2 * | 11/2005 | Ping | 30/156 |
| D516,263 | S | 2/2006 | Gringer et al. | |
| 7,007,392 | B2 * | 3/2006 | Ping | 30/156 |
| 7,040,022 | B2 * | 5/2006 | Ping | 30/161 |
| 7,055,407 | B2 | 6/2006 | Gringer et al. | |
| D531,003 | S | 10/2006 | Collins | |
| 7,134,207 | B2 * | 11/2006 | Ping | 30/153 |
| D537,591 | S | 2/2007 | Gringer et al. | |
| D549,543 | S | 8/2007 | Tsai | |
| 7,325,313 | B2 | 2/2008 | Gringer et al. | |
| 7,346,988 | B2 | 3/2008 | Gringer et al. | |
| 7,380,341 | B2 * | 6/2008 | Ping | 30/161 |
| D584,871 | S | 1/2009 | Arvinte et al. | |
| 7,475,480 | B2 * | 1/2009 | Votolato | 30/2 |
| 7,480,997 | B2 * | 1/2009 | Ping | 30/161 |
| 7,509,742 | B2 * | 3/2009 | Votolato | 30/151 |
| D605,911 | S | 12/2009 | Lian et al. | |
| D606,375 | S | 12/2009 | Divita | |
| 7,694,422 | B2 | 4/2010 | Vaes | |
| D622,114 | S | 8/2010 | Balliet | |
| 7,797,835 | B2 * | 9/2010 | Zeng | 30/153 |
| 7,814,664 | B2 * | 10/2010 | LeBlanc et al. | 30/161 |
| D634,600 | S | 3/2011 | Gringer et al. | |

(56) References Cited

U.S. PATENT DOCUMENTS

| | | | | |
|---|---|---|---|---|
| 8,046,922 | B2 * | 11/2011 | Eby et al. | 30/151 |
| 8,720,068 | B2 * | 5/2014 | Landwehr | 30/2 |
| 8,732,956 | B2 * | 5/2014 | McGushion et al. | 30/151 |
| 8,769,826 | B2 * | 7/2014 | Wu | 30/2 |
| 2002/0124412 | A1 * | 9/2002 | Votolato | 30/200 |
| 2002/0124418 | A1 * | 9/2002 | Votolato | 30/294 |
| 2003/0110570 | A1 | 6/2003 | Gringer | |
| 2003/0110641 | A1 | 6/2003 | Gringer | |
| 2004/0045167 | A1 | 3/2004 | Gringer et al. | |
| 2005/0097753 | A1 | 5/2005 | Gringer et al. | |
| 2005/0097756 | A1 | 5/2005 | Gringer et al. | |
| 2005/0193568 | A1 * | 9/2005 | Peyrot et al. | 30/162 |
| 2006/0080843 | A1 | 4/2006 | Gringer et al. | |
| 2006/0162106 | A1 | 7/2006 | Ross | |
| 2007/0169353 | A1 * | 7/2007 | Wu | 30/155 |
| 2008/0083118 | A1 * | 4/2008 | Steigerwalt et al. | 30/160 |
| 2008/0163493 | A1 * | 7/2008 | Votolato | 30/154 |
| 2008/0289190 | A1 * | 11/2008 | Jennings et al. | 30/155 |
| 2009/0199409 | A1 * | 8/2009 | Zeng | 30/154 |
| 2009/0313836 | A1 * | 12/2009 | Wei | 30/162 |
| 2010/0162509 | A1 | 7/2010 | Liao | |
| 2010/0162573 | A1 | 7/2010 | Liao | |
| 2010/0263214 | A1 * | 10/2010 | Robinson et al. | 30/156 |
| 2010/0269348 | A1 * | 10/2010 | Gringer | 30/2 |
| 2012/0066910 | A1 * | 3/2012 | Shantha | 30/122 |
| 2013/0185943 | A1 * | 7/2013 | Landwehr | 30/153 |
| 2013/0298740 | A1 * | 11/2013 | Gringer et al. | 30/162 |
| 2014/0075762 | A1 * | 3/2014 | Gringer et al. | 30/162 |
| 2014/0109413 | A1 * | 4/2014 | Landwehr | 30/153 |
| 2014/0208594 | A1 * | 7/2014 | Scimone et al. | 30/2 |
| 2014/0259686 | A1 * | 9/2014 | Garavaglia et al. | 30/156 |

OTHER PUBLICATIONS

OLFA Products, Safety Cutters & Blades, www.olfa.com, 2007.
Lewis Knives, Knives and Blades, 2007, p. 5.
Pacific Handy Cutter, Safety First System, Store Supply Safety Catalog, 2004.
Olo Safety Carton Cutter, Division of World Kitchen, Inc., Flyer, 2007.
Stanley Hand Tools, Knives, Fixed Blades, The Stanley Works, 2005.
"Tile Installation Tools", Ace Industrial (NINGBO) Co., Ltd, 2005.
BISS Product Development, Striker Hand Tools, www.StrikerHandTools.com, admitted prior Art.
Husky Medium Utility Knife (front and back views), admitted prior art.
Husky Sure-Grip Folding Lock-Back Utility Knife, admitted prior art.
Nebo Tools, The Perfect All Purpose Work-Knife, Folding Lock-Back Blade & Lock-Blade Utility Knife, admitted prior art.
Rong Xin Tools, Folding Lock-Back Utility Knife, admitted prior art.

* cited by examiner

CUTTING IMPLEMENTS

This application claims the benefit of U.S. Provisional Application Ser. No. 61/335,718, filed Jan. 11, 2010, the content of which is incorporated herein by reference.

BACKGROUND OF THE INVENTION

1. Field of the Invention

The present disclosure is related to cutting implements. More particularly, the present disclosure is related to knives, and more specifically to utility knives configured for enhanced safety during their use.

2. Description of Related Art

Knives are well known in the art and are currently available is various forms. Such forms include fixed blade knives, folding knives, utility knives, and the like.

Fixed bladed or straight knives typically have a protective sheath for storage for covering the exposed blade. Such sheaths are constructed using thick leather sheets to ensure a safe covering of the blade during transport and storage. If the sheath is lost or damaged, the knife may produce an inadvertent cutting hazard. These types of knives are also bulky due to the combined length of the handle and blade.

Folding knives are also well known in the art. These knives typically have a handle and a blade pivotably associated with the handle. When the blade is not in use, the blade can be folded where the cutting edge is contained inside an opening of the handle. This allows safer and less bulky storage of the knife when not in use or during transport. However, there still exists a hazard with such knives. During use, the user is required to grasp the handle which places the hand in the path of the handle opening. During use, it has been observed that the blade can close and cause an inadvertent cut when moving towards the opening of the handle. It has also been observed that the opening and closing of such folding knives typically requires a two-handed operation. When attempted to open or close such folding knives using a single hand, difficulty is encountered which can increase the chance of injury.

In order to mitigate this effect, folding knives have been configured to maintain the blade in the open position during use. This has been known to reduce inadvertent closing of the blade during use. However, this type of mechanism employed typically consists of a spring loaded arm configured to mate with a first flat on a cylindrical surface of the rotating blade. The flat is placed at a predetermined location allowing the blade to remain in the desired open (cutting) position. The spring force of the arm maintains the blade in the open position. During use, it has been observed that these types of knives can cause injury. For example, if the spring force holding the blade can be overcome during use, the blade can close on the user's hand during handling. In addition, these folding knives are configured to also keep the blade in the closed position inside the handle. The same spring force is also applied to a second flat opposite the first flat. Unfortunately, the transition to the second flat from the cylindrical surface typically causes the blade to accelerate into the closed position from the spring force. This acceleration has been known to cause inadvertent cuts during the closing or use of such folding knives. As detailed above, these types of folding knives also require a two-handed operation.

Some improvements have been employed to ensure the blade remains locked in the open (cutting) position during use. These improvements have been known to eliminate inadvertent closing of the blade during use. This type of mechanism is similar to the above and typically consists of a spring loaded arm with a tab on a first end and a user actuator on a second end. The tab is configured to fit within a locking recess contained on a cylindrical surface on the rotating blade. The locking recess is placed at a predetermined location allowing the blade to remain locked in the desired open position. As described above, these locking knives are also configured to keep the blade in the closed position inside the handle. The spring loaded arm is also applied to a flat contained on a portion of the cylindrical surface opposite the blade locking recess. During closure of the blade, the user typically depresses the actuator to release the blade and begins to fold the blade in the closed position. Before closure, the user typical releases the actuator and the tab on the spring loaded arm rests on a cylindrical surface. Unfortunately, the transition to the flat typically causes the blade to accelerate into the closed position from the spring force. This acceleration has been known to cause inadvertent cuts during the closing of such folding knives. As detailed above, these types of folding knives still require the aforementioned two-handed operation.

Utility knives are well known. These types of knives typically allow the use of disposable blades to avoid the need of blade sharpening. Many forms are available such as a retractable version. The blade is disposed, for example within its housing, and can be selectively extended and retracted by engaging an external member. The external member actuates a carriage which houses the blade and allows the user the ability to retract the blade.

Folding utility knives have been increasing in popularity. These utility knives typically consist of substantially similar mechanisms as the aforementioned folding knives with the added feature of selectively retaining and removing disposable blades. Unfortunately, since these mechanisms are substantially similar as detailed above, they too suffer from the same concerns as the above mentioned folding knives.

The knives as described above also lack operational resistance when left unattended. Such knives can cause injury to a child if encountered.

Therefore, there is a need for knives that overcome, alleviate, and/or mitigate one or more of the aforementioned and other deleterious effects of prior art knives.

BRIEF SUMMARY OF THE INVENTION

Cutting implements are provided that include features for enhanced safety. Such cutting implements allow ease of use for the intended user while maintaining operational resistance for the unintended user. Some cutting implements also allow for a single-handed operation during use.

In one embodiment, a knife is provided that includes a blade guard configured to cover the cutting edge when the knife is not in use. The guard is maintained in a normally blade covered position by a resilient member. The blade guard has a guard actuator for providing at least one motion for moving the blade guard from the normally blade covered position to an un-guarded or cutting position.

In some embodiments, the blade guard is locked in a blade covering position so that the blade guard has an increased operational resistance for placing the knife in the un-guarded or cutting position. The increased resistance includes one or more motions to unlock the blade guard so that the blade guard can be placed in the un-guarded (cutting) position.

In some embodiments, the knife is configured to have a permanent blade or is configured to allow the use of disposable blades.

A folding knife for applying a cutting action is provided that includes a blade assembly having a guard configured to cover the cutting edge of the blade when the knife is not in use.

The guard is maintained in a normally blade covered position by a resilient member. The blade guard has a guard actuator for providing at least one motion for a user to move the blade guard from the normally blade covered position to an un-guarded or cutting position. The blade guard is locked in a blade covering position so that the blade guard has an increased operational resistance for placing the knife in the un-guarded or cutting position. The increased resistance includes one or more motions to unlock the blade guard so that the blade guard can be placed in the un-guarded (cutting) position. The folding knife comprises a housing having the blade assembly locked in a closed position and is pivotably associated with the housing. The knife further comprises an actuator for unlocking the blade assembly from the closed position to a locked open position. The actuator further comprises a locking tab and the blade assembly further comprises a locking slot. The locking tab is configured to lock the blade guard in the un-guarded or cutting position. The housing further comprises a resilient member urging the blade assembly in the open position. Upon depression of the actuator, the blade assembly will automatically open to the locked open position from the locked closed position.

A knife is provided to allow the use of disposable blades. The knife is configured to allow the user to selectively remove and reverse or replace disposable blades.

The above-described and other features and advantages of the present disclosure will be appreciated and understood by those skilled in the art from the following detailed description, and drawings.

BRIEF DESCRIPTION OF THE SEVERAL VIEWS OF THE DRAWINGS

FIG. 40 is a cross section view taken along line 168-168 of FIG. 39; and FIG. 41 is a cross section view taken along line 170-170 of FIG. 39.

DETAILED DESCRIPTION OF THE INVENTION

Figure 1:
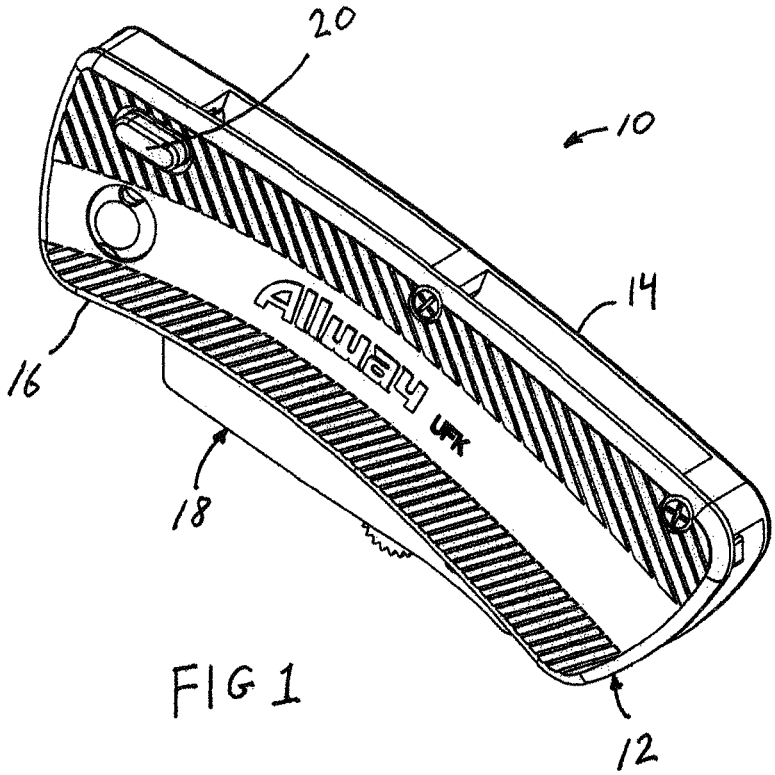
FIG. 1 is a perspective view of a first exemplary embodiment of a cutting implement in the locked closed (guarded) position according to the present disclosure.

Referring to the drawings and in particular to FIGS. 1 through 6, a cutting implement according to an exemplary embodiment of the present disclosure is shown having reference numeral 10. Cutting implement 10 (hereafter knife) includes a housing 12, a blade assembly 18 pivotably associated with housing 12, an actuator 20, a blade guard 24, and a guard actuator 26.

Advantageously, blade assembly 18 is configured to be urged in a normally locked open position (first open position) (FIGS. 3 & 4) from a locked closed position (FIG. 1). The urging force F1 is directed away from the blade cutting edge 38 (FIG. 2) by a resilient member that will be described in detail below. Upon user depression of actuator 20 along direction 37, blade assembly will unlock from housing 12 and automatically transition to a first open position along radial direction 22, about axis A1. In addition, blade assembly 18 is further configured to guard cutting edge 38 when knife 10 is locked in the closed position (FIG. 1), throughout the transition (FIG. 2) to the open position, and in the first open position. As best seen in FIGS. 3 & 4, knife 10 is in the guarded position when knife 10 is placed in the first open position. Therefore knife 10 is defined to be in the first open position when cutting edge 38 is guarded by blade guard 24 as illustrated in FIGS. 3 & 4. In this example, blade guard 24 is maintained in the guarded position by a locking member and an urging force F2 (FIG. 5) utilizing a resilient member that will be described in detail below.

Figure 2:
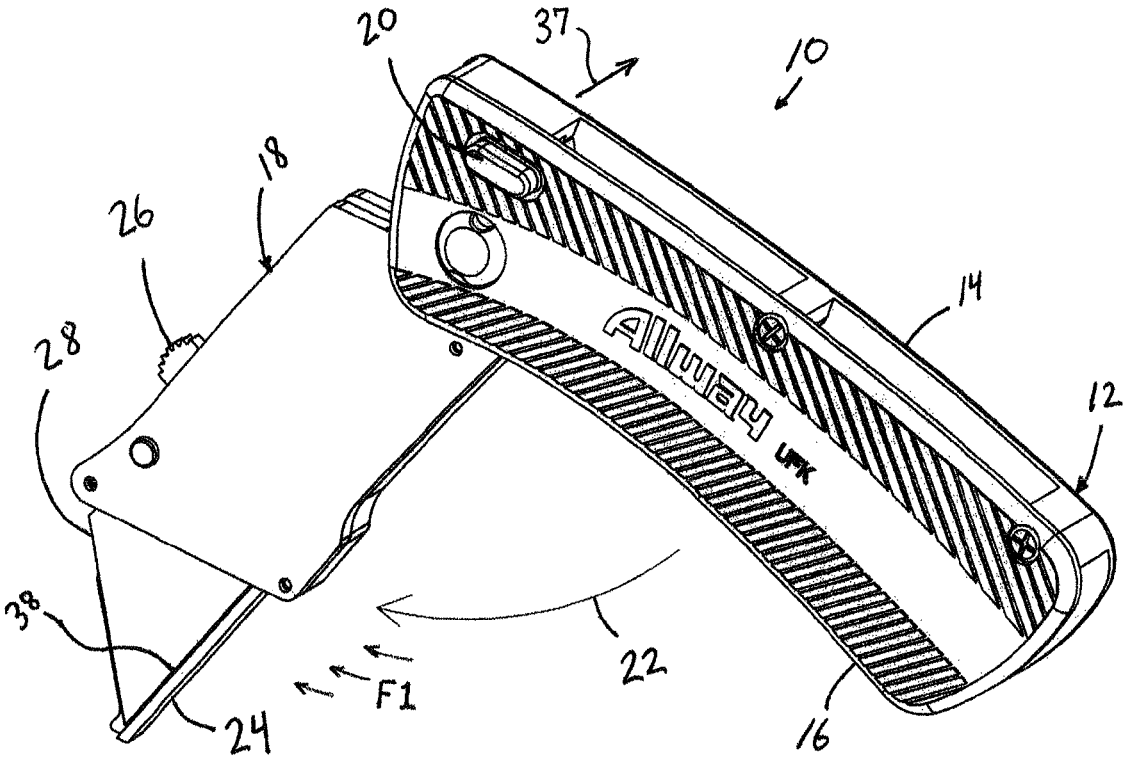
FIG. 2 is a perspective view of the cutting implement of FIG. 1 in transition to the first open position.
Figure 3:
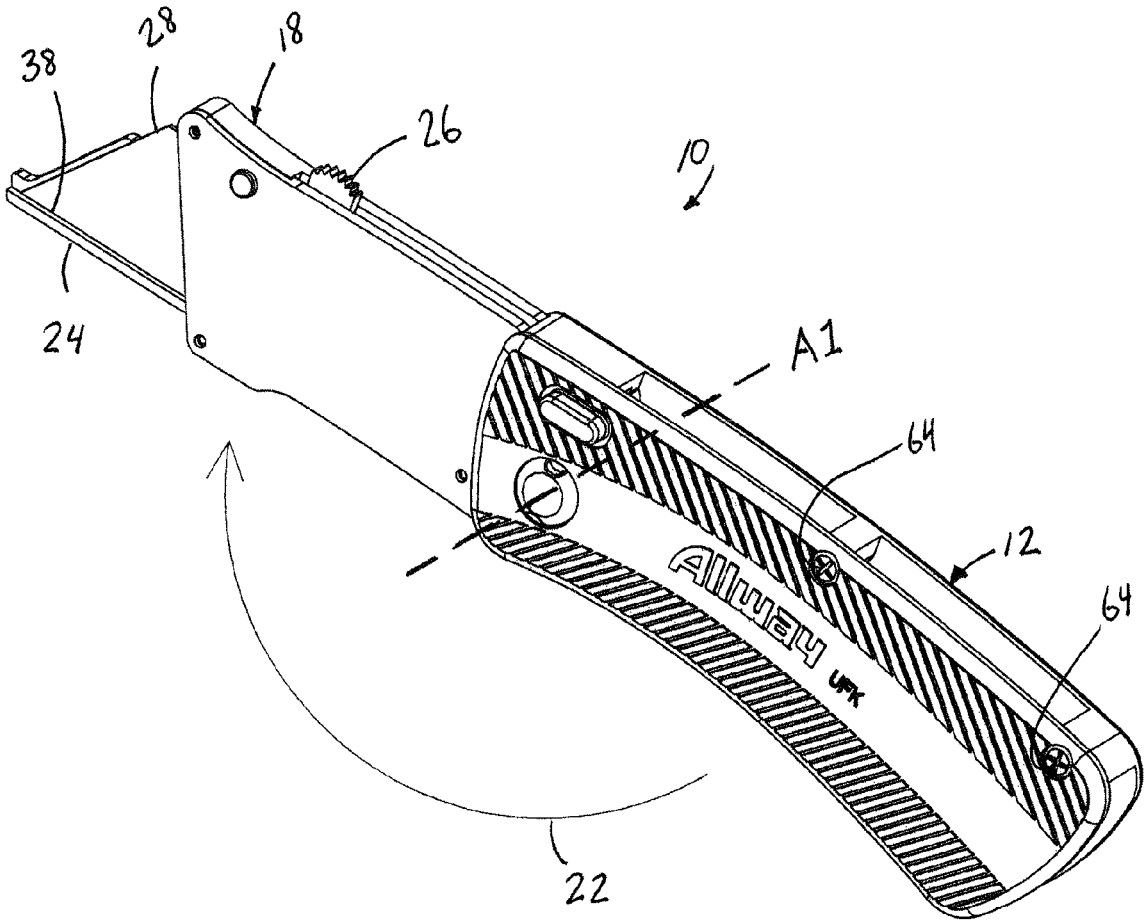
FIG. 3 is a perspective view of the cutting implement of FIG. 1 shown in the first open (guarded) position.
Figure 4:
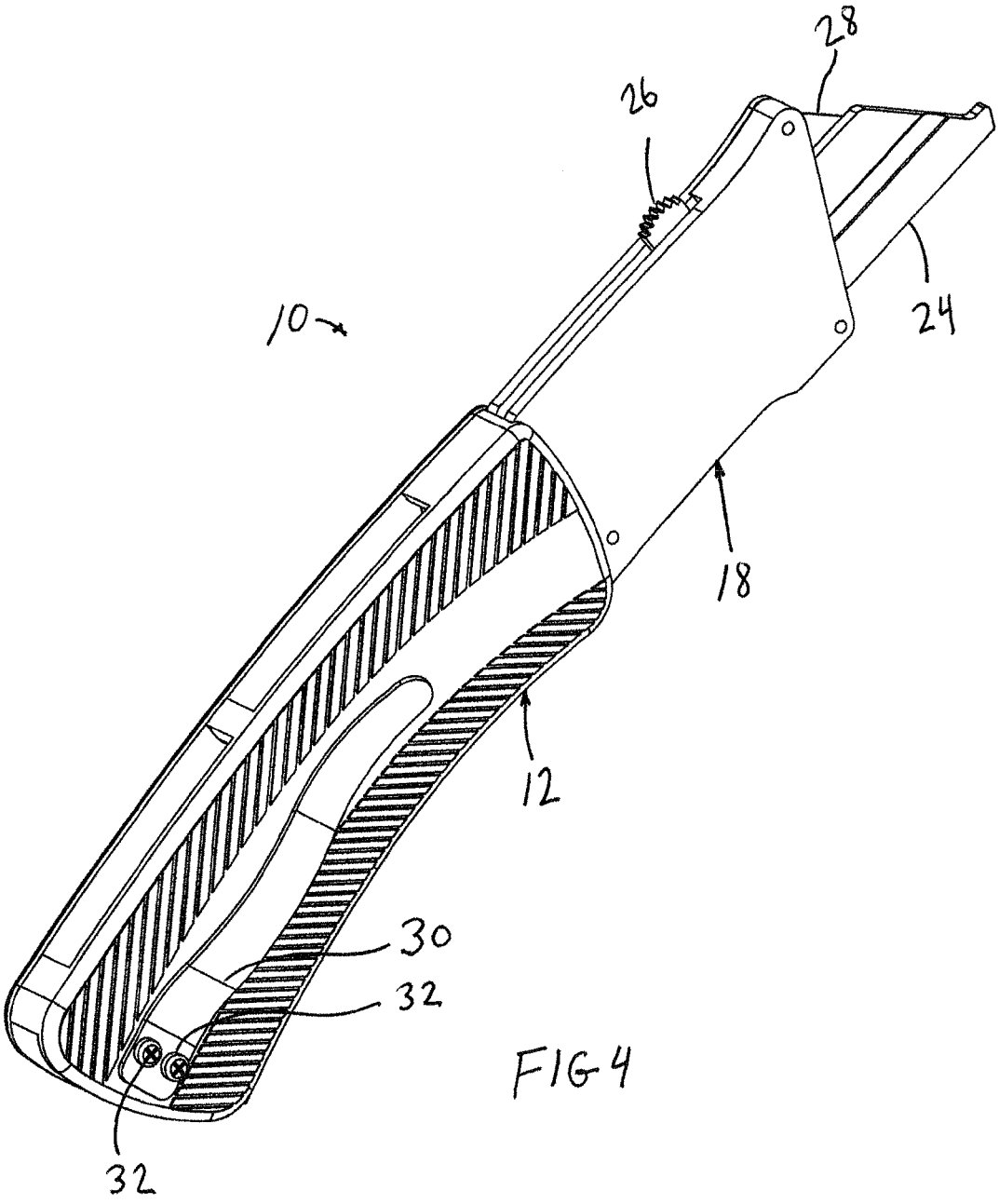
FIG. 4 is a perspective view of the cutting implement of FIG. 1 shown in the first open (guarded) position illustrating the opposite side as compared to FIG. 3.
Figure 5:
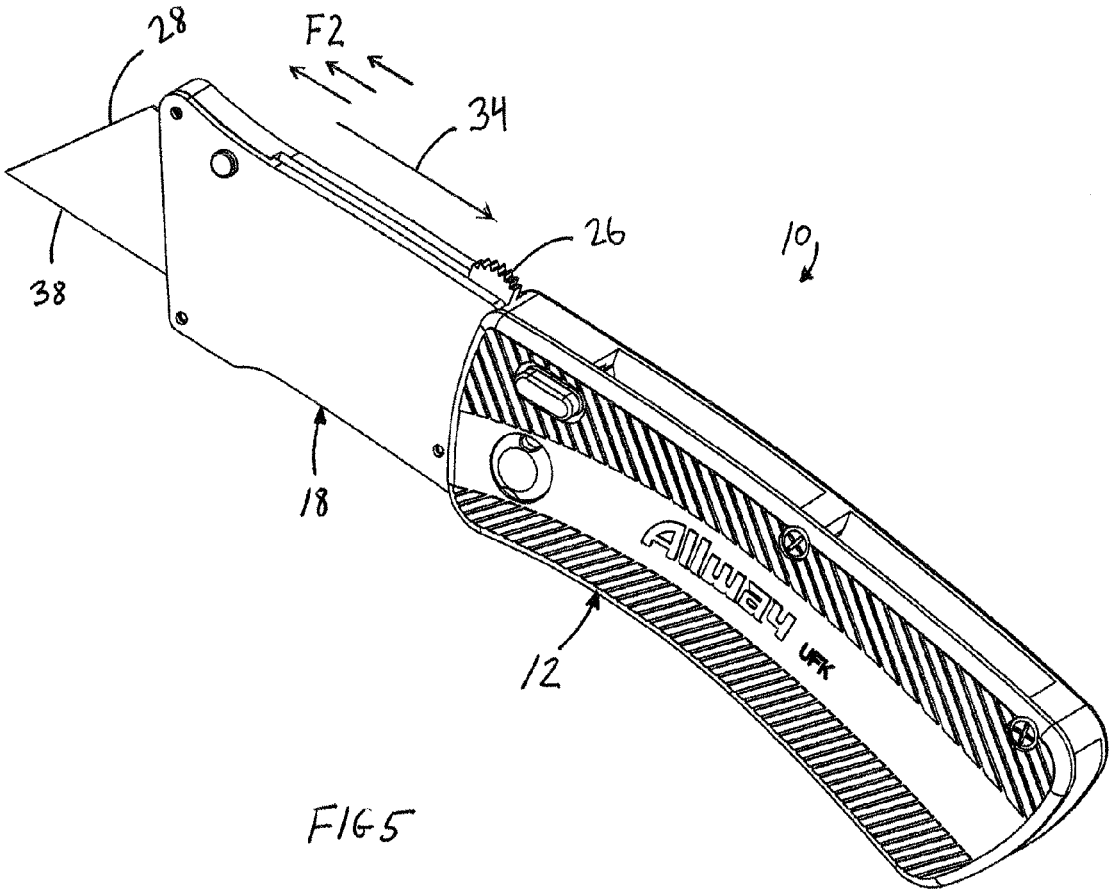
FIG. 5 illustrates is a perspective view of the cutting implement of FIG. 1 shown in the second open (un-guarded or cutting) position.
Figure 6:
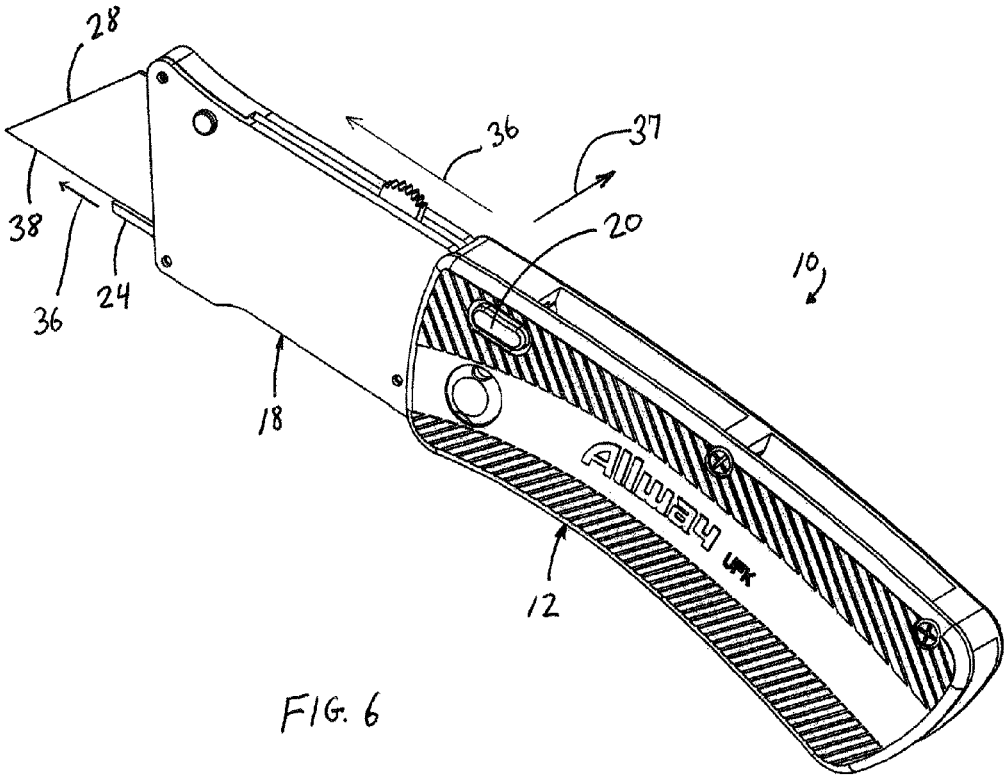
FIG. 6 illustrates is a perspective view of the cutting implement of FIG. 1 in transition from the second open (un-guarded or cutting) position to the first open (guarded) position.

By simultaneous reference of FIGS. 2 through 4, cutting edge 38 of blade 28 is guarded by blade guard 24. Advantageously, blade guard 24 further comprises guard actuator 26 which allows a user to place knife 10 in a second open (unguarded or cutting) position as illustrated in FIG. 5. As illustrated in FIG. 5, guard actuator 26 is slidably associated with blade assembly 18 and can be moved along a direction 34 by a user overcoming force F2. Advantageously, knife 10 is configured to lock blade guard 24 in the second open (unguarded or cutting) position. The selective depression of actuator 20 along direction 37 (FIG. 6) will simultaneously unlock blade guard 24 and blade assembly 18 wherein blade guard 24 will automatically transition (directional arrows 36) to the guarded position from force F2. This allows a safe operation for the user when urging (folding) blade assembly 18 back in the locked closed position (FIG. 1). The urging force F1 (FIG. 2) is opposite the cutting 38 of blade 28 and prevents inadvertent acceleration of blade assembly 18 into the closed position thereby providing enhanced safety during this transition into the locked closed position.

To facilitate transport, knife 10 further comprises an optional clip 30 (FIG. 4) secured by one or more fasteners 32 on a first end. In this example, clip 30 is formed of spring steel thereby providing an urging force on housing 12 on a second end. The urging force allows for a user to insert the knife through an open edge such as a belt or pocket opening of a garment. The urging force resists motion and maintains knife 10 substantially in the same position for later use. In the example provided, fasteners 32 are screws positioned in openings 78; however it is contemplated by this disclosure that other options are possible to secure clip 30 to knife 10 including and not limited to adhesives, snap fit, welding, among others. It is also contemplated by this disclosure that clip 30 can be formed of other materials such as stainless steel, plastics, etc and can also be integral to housing 12 instead of a separate attached component.

Figure 7:
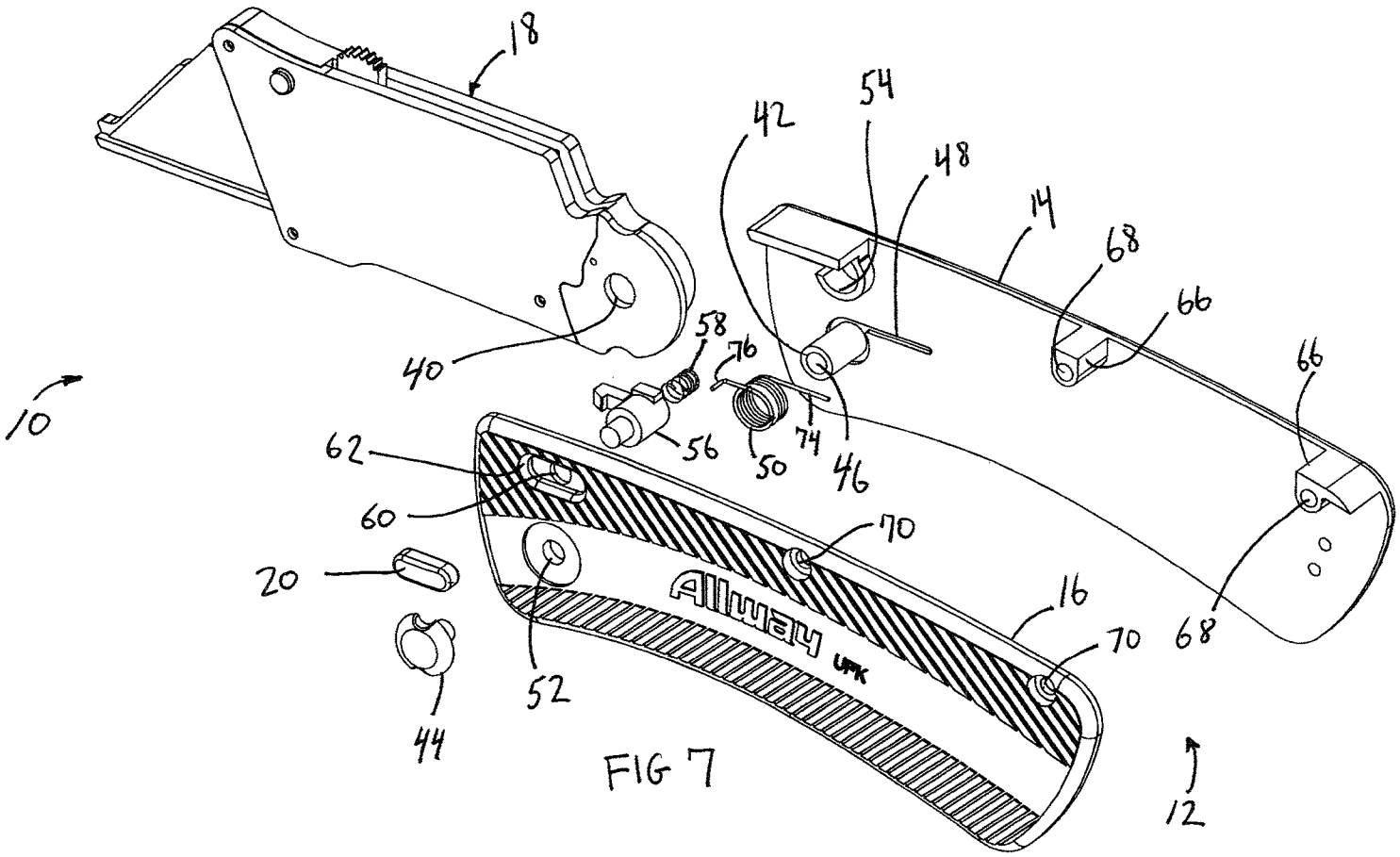
FIG. 7 is a first perspective exploded view of the cutting implement of FIG. 1.
Figure 8:
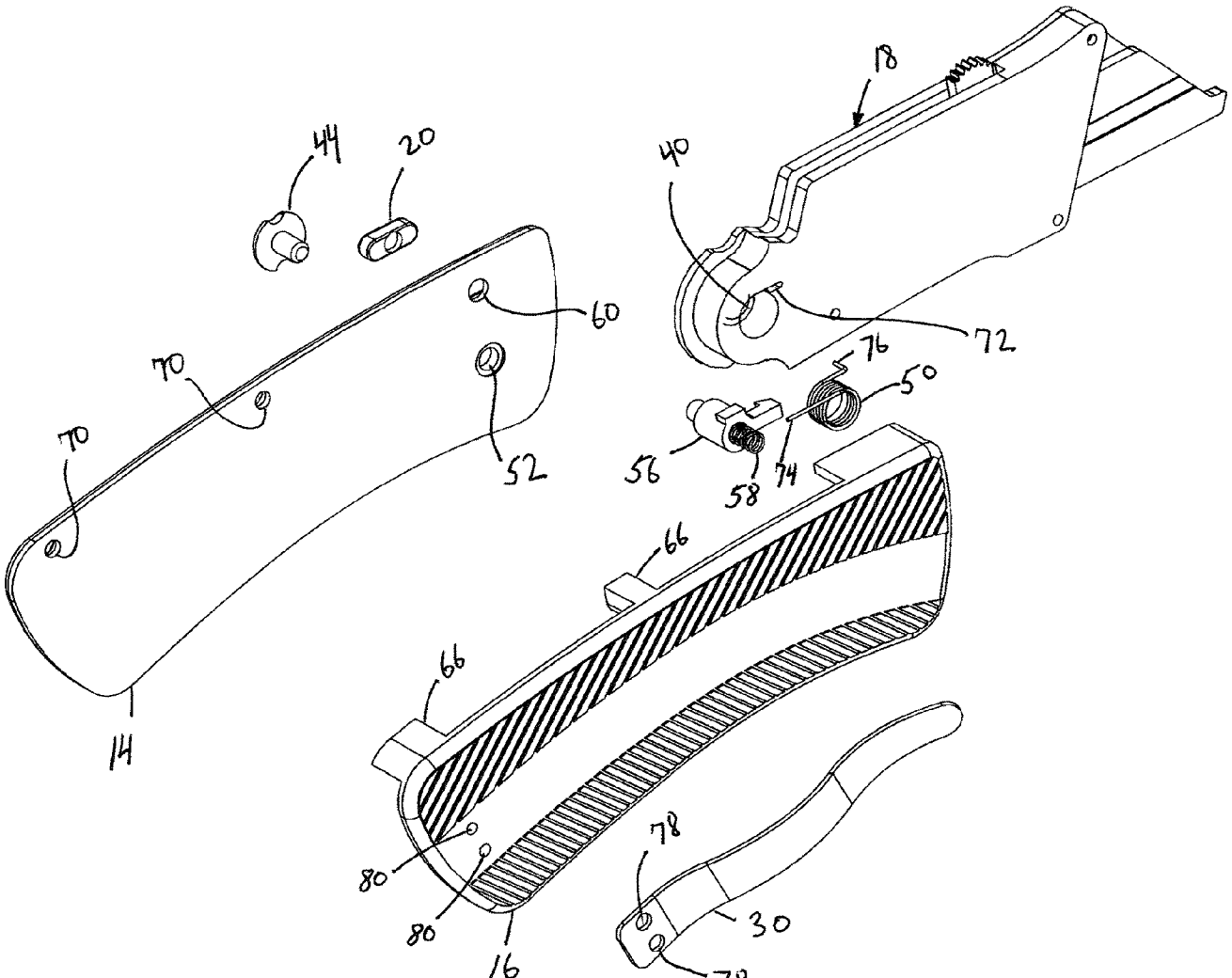
FIG. 8 is a second perspective exploded view of the cutting implement of FIG. 1.
Figure 9:
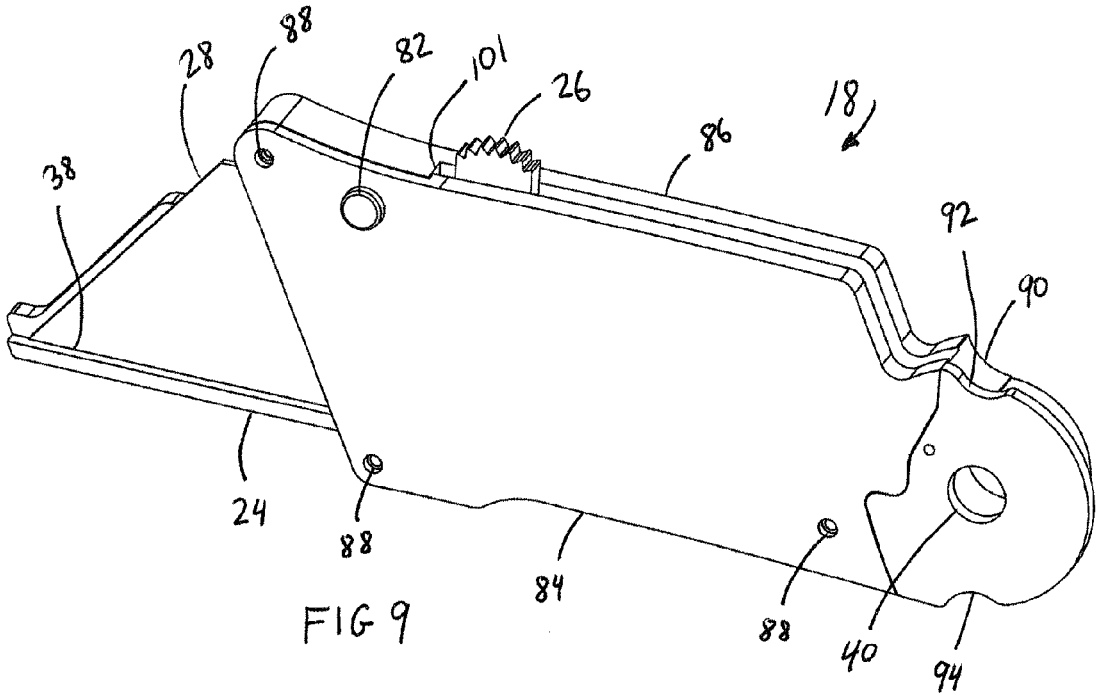
FIG. 9 is a first perspective view of the blade assembly of the cutting implement of FIG. 1.

As seen in FIGS. 7 and 8, knife 10 has housing 12 formed by first housing member 14 and second housing member 16. In this example, housing 12 comprises two components, however it is contemplated by this disclosure that housing 12 can have a single component such as a die cast metal or plastic injection molded housing. It is also contemplated by this disclosure that housing 12 can comprise more than two components. In this example first and second housing members 14, 16 are formed of metal. Such metal can include machined steel or aluminum or processed using die cast manufacturing. First housing member 14 has boss 42 with screw hole 46 and openings 80. First housing member also comprises one or more bosses 66 with screw holes 68. These provide the necessary features for attaching second housing member 16 to first housing member 14. Second housing member 16 comprises one or more holes 52, 60, 62 and 70. Screw 44 passes through hole 52 and threads into screw hole 46 for securing first housing member 14 to second housing member 16. One or more screws 64 (FIG. 3) inserts through holes 70 and into screw holes 68 which further secures first housing member 14 to second housing member 16. As described in this example, first housing member 14 and second housing member 16 are attached using screws, however it is contemplated by this disclosure that other methods of attachment are possible for attaching first housing member 14 to second housing member 16 including and not limited to snap fit, welding, among others.

Figure 10:
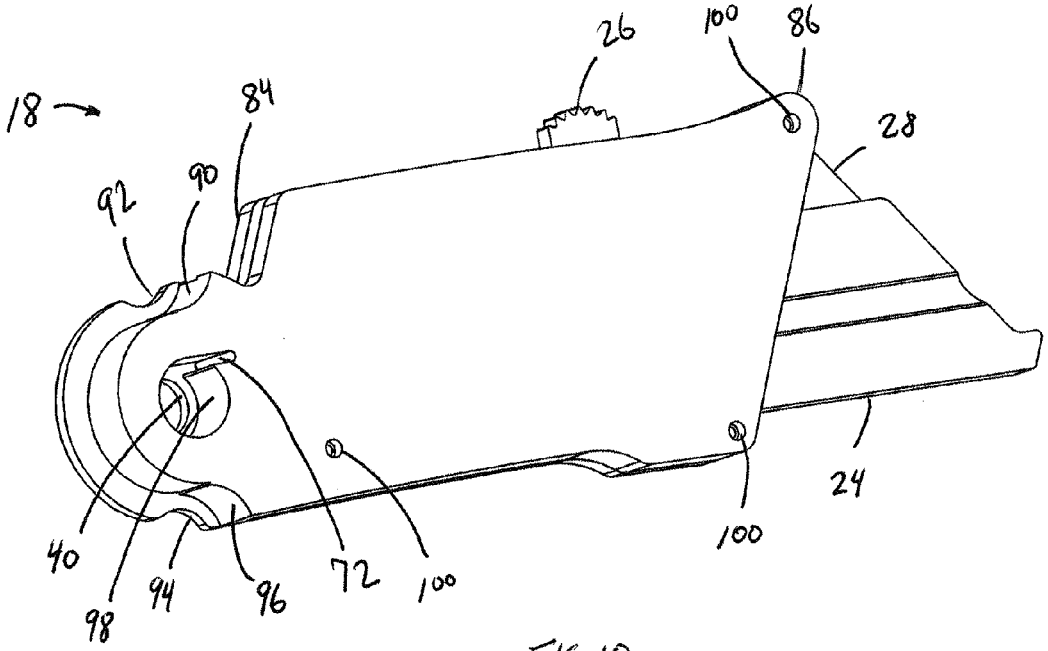
FIG. 10 is a second opposite side perspective view of the blade assembly of the cutting implement of FIG. 1.
Figure 11:
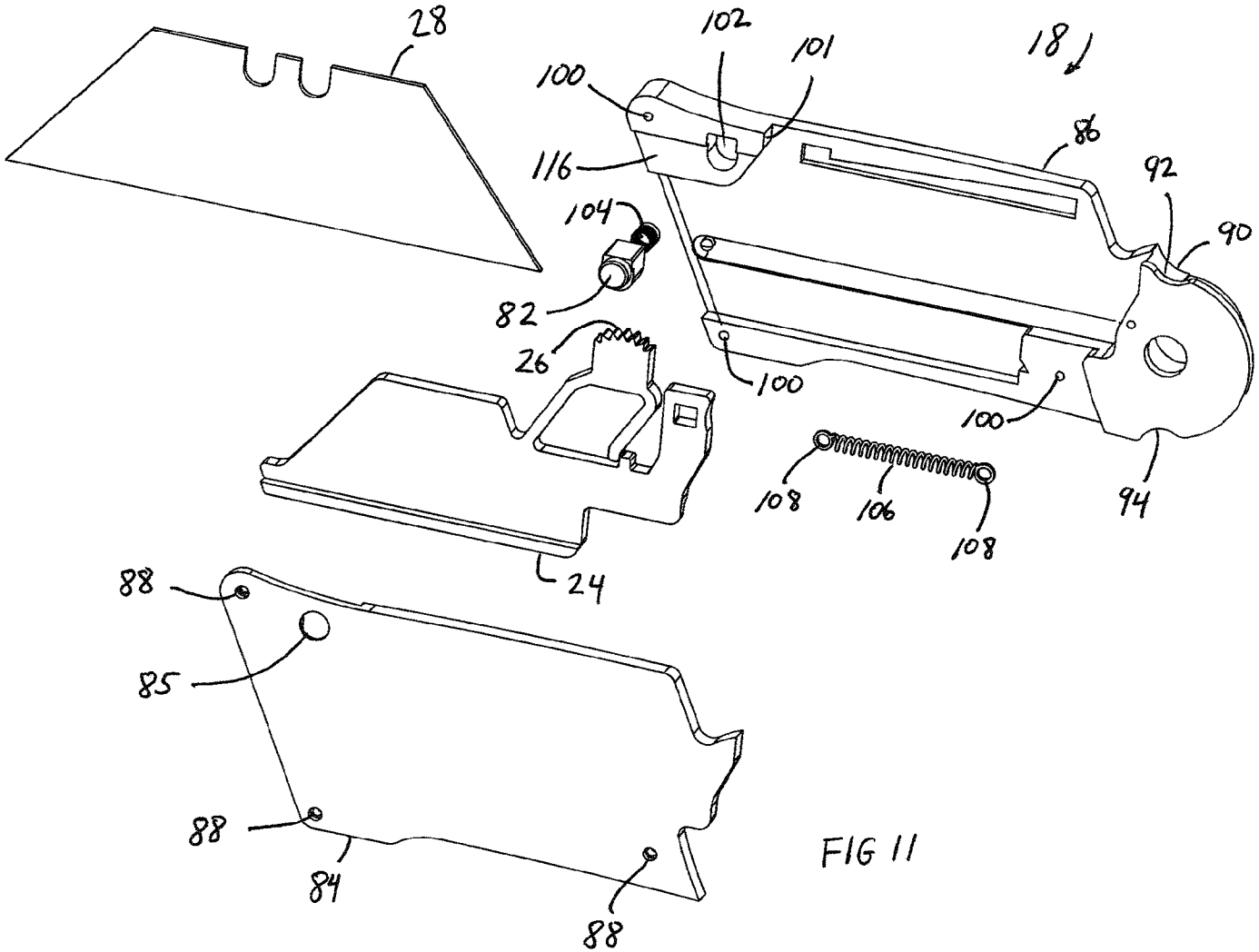
FIG. 11 is an exploded view of the blade assembly of FIGS. 9 & 10.
Figure 12:
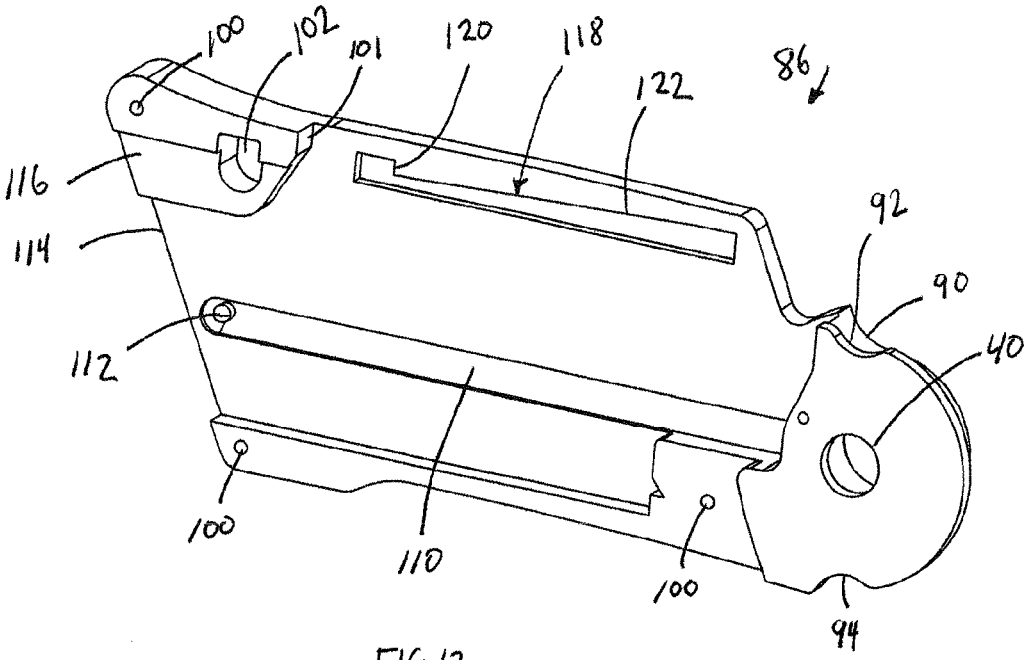
FIGS. 12 through 16 are detail views of the various components of the blade assembly of FIG. 11.
Figure 13:
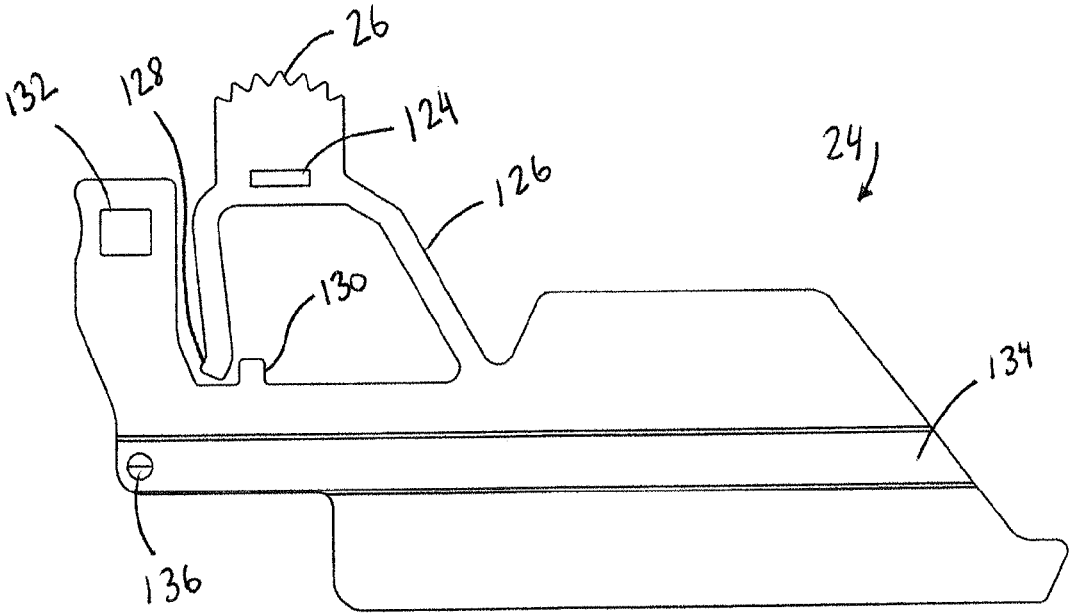
Figure 14:
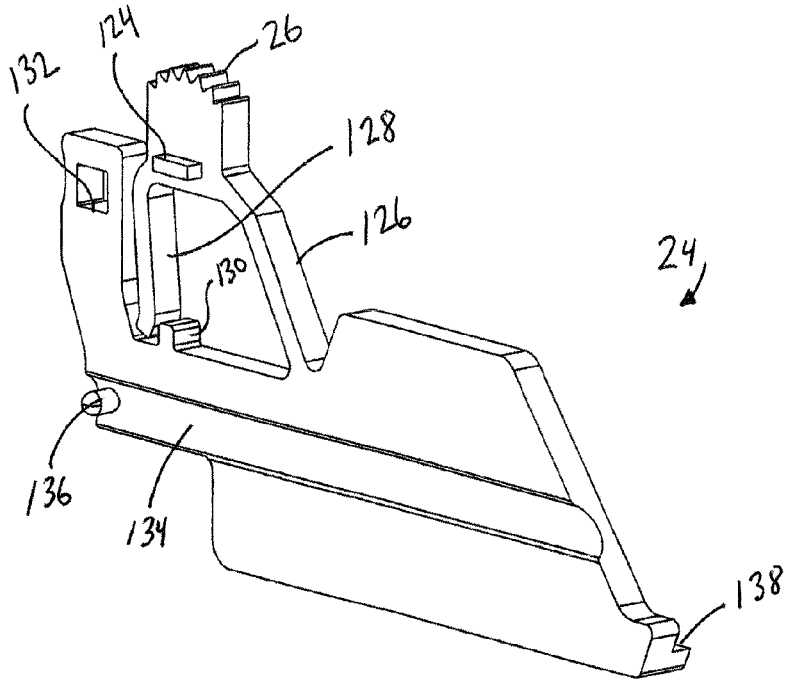

Knife 10 includes resilient member 50 which provides the aforementioned force F1. In this example, resilient member 50 is a torsion spring but it is contemplated by this disclosure that resilient member 50 can be any component that can provide an urging force such as leaf spring, helical compression springs, elastomers, etc. Resilient member 50 (hereafter torsion spring 50) has a first end 74 and a second end 76. First end 74 assembles into first spring retainer 48 on first housing member 14. Second end 76 assembles into second spring retainer 72 on blade assembly 18. Blade assembly 18 further includes spring bore 98 (FIG. 10) to allow torsion spring 50 to be inserted therein. In this example, boss 42 is inserted through torsion spring 50 and blade assembly bore 40 before screw 44 is secured to first housing member 14. This configuration allows blade assembly 18 to be normally urged in the open position (normally open position).

Knife 10 further comprises locking member 56 and resilient member 58 (hereafter locking member spring 58). By simultaneous reference to FIGS. 7, 8, 17, & 18, locking member 56 is explained in detail. Locking member 56 has pin 142 configured to insert into slot 156 to contain actuator 20. In this example, actuator 20 is retained via press fit of pin 142 to slot 156. However, one skilled in the art can appreciate that other options are possible to retain actuator 20 to pin 142 including and not limited to adhesive, welding, mechanical fasteners, and others. In this example, actuator 20 and locking member 56 are shown and described as being constructed in two components; however it is contemplated by this disclosure that actuator 20 and locking member 56 can be fabricated as a single component. Actuator 20 is shown as having a substantially oval shape, however other shapes are also possible such as and not limited to circular, square, among others. Locking member 56 further includes spring bore 154 to allow locking member spring 58 to insert therein. Locking member 56 also comprises locking arm 144 with lead in surface 146. In addition, locking member 56 further includes slot 157 and actuator leg 152.

In this example, locking member 56 and actuator 20 are fabricated out of metal such as steel; however it is contemplated by this disclosure that locking member 56 and actuator 20 can be fabricated out of any material such as aluminum, brass, and plastic, among others.

Figure 20:
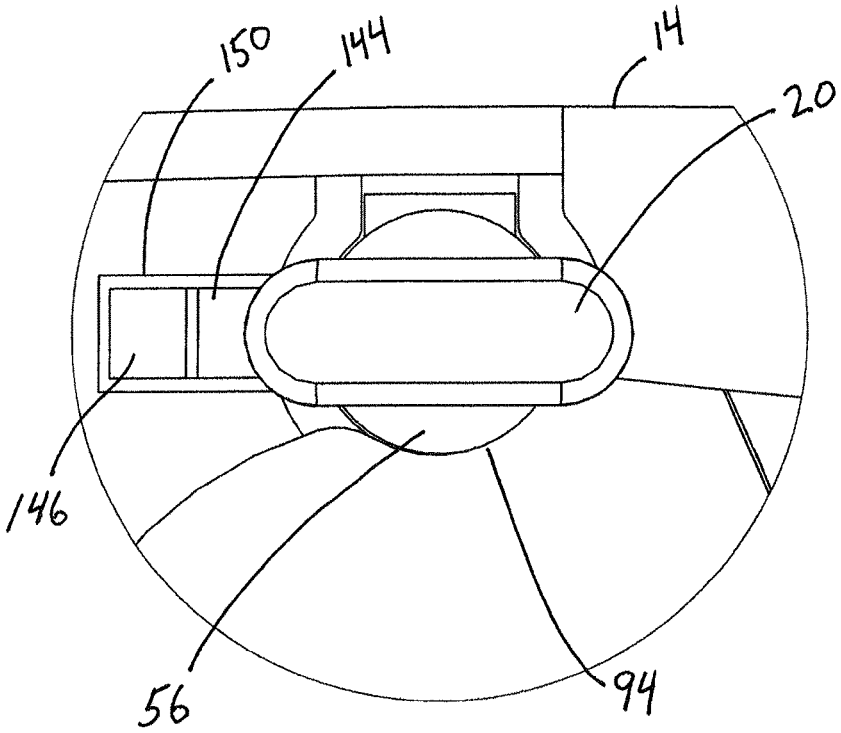
FIG. 20 is a detail view taken from FIG. 19.
Figure 21:
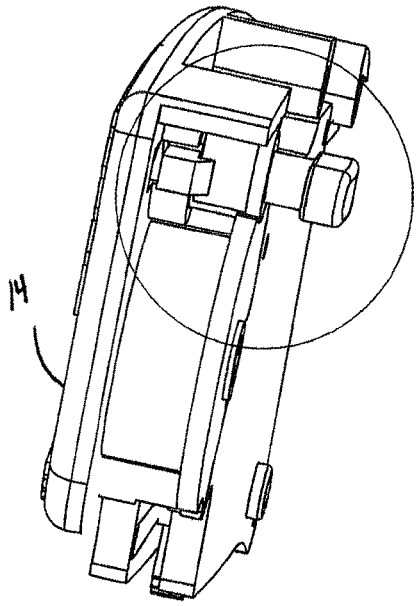
FIG. 21 is a perspective view of the cutting implement as shown in FIG. 19 illustrating the locking of the blade assembly.

Locking member spring 58 is shown as a coil compression spring, however one skilled in the art can appreciate other substitutions are available such as and not limited to compressible elastomers, leaf springs, plastic springs, etc. In this example, locking member 56 is assembled to first housing member 14. First housing member 14 has first locking bore 54, key slot 148, and pocket 150. Actuator leg 152 and locking arm 144 is configured to fit within key slot 148 and pocket 150 respectively, as illustrated in FIG. 20.

Blade assembly 18 will be described in detail by simultaneous reference to FIGS. 9 through 16. Blade assembly 18 has first frame 84 and second frame 86. In the example provided, first frame 84 and second frame 86 each contain one or more collinear retaining slots 88/100. In this example retaining slots 88/100 are complimentary holes which allow the use of rivets for affixing first frame 84 to second frame 86. Of course it is contemplated by this disclosure that first frame 84 and second frame 86 can be joined together by other methods including and not limited to welding, screwing, snap-fit, adhesive, among others. First frame 84 and second frame 86 can be fabricated in any manor and can be made of any material. In the example provided, first frame 84 and second frame members 86 are fabricated in die cast aluminum. First frame 84 further includes opening 85.

To facilitate guard actuator 26, second frame 86 has offset 101 which allows guard actuator to translate (slide) within blade assembly 18. This allows the user to selectively lock knife 10 in the unguarded position from the guarded position. The locking features will be described in detail below.

Figure 36:
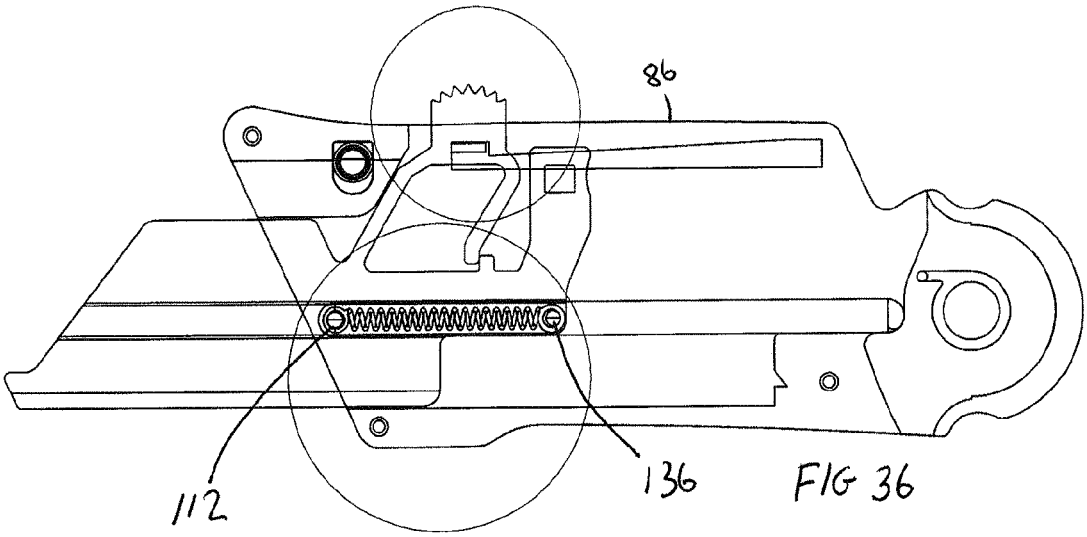
FIGS. 36 through 47 illustrate various functions of the components of the blade assembly as shown in FIG. 11.
Figure 37:
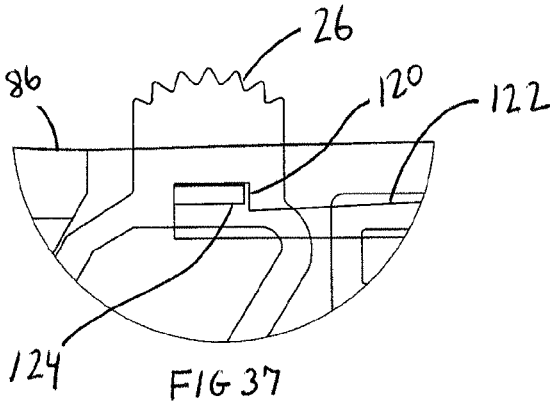
Figure 38:
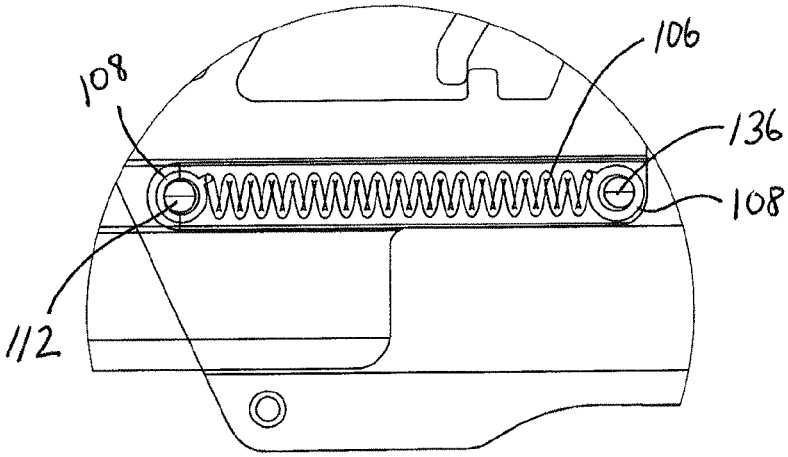

Second frame 86 comprises first longitudinal slot 110 and first retaining pin 112 configured for assembly of a first loop 108 of return spring 106. First retaining pin 112 if positioned nearest side 114 of second frame 86. Blade guard 24 further includes second longitudinal slot 134 and second retaining pin 136 also configured for assembly of a second loop of return spring 108. The assembly of return spring 108 to blade guard 24 and second frame 86 provides the aforementioned guard urging force F2 (FIG. 5). In the example provided, return spring 106 is a helical extension spring. Of course it is contemplated in this disclosure that the guard urging force F2 can be produced by other components such as and not limited to elastomer springs, compression springs, magnets, among others. FIGS. 36 and 38 illustrate a wireframe view of the assembly of return spring 108 to blade guard 24 and second frame 86 producing the guard urging force F2.

To facilitate the assembly and the retention of blade 28, second frame 86 further includes release bore 102, which extends to member 116. Release bore 102 is configured to receive resilient member 104 and release member 82. Release member 104 fits inside bore 105 (FIGS. 40 through 43) wherein release member 104 provides an urging force to retain blade 28. In this example, release member 104 (hereafter release spring 104) is a coil compression spring. However it is contemplated by this disclosure that release spring 104 can be substituted by other suitable configurations such as and not limited to compressible elastomers, leaf springs, plastic coil springs, etc. Blade 28 can be selectively removed via depression of release member 82 which is described in detail below. In this example, release member 82 is fabricated of metal such as steel. One having ordinary skill in the art can appreciate that release member 82 can be fabricated out of numerous materials such as and not limited to aluminum, zinc, plastic, among others. It is also contemplated by this disclosure that release member 82 can be fabricated using several manufacturing methods including and not limited to die-casting, injection molding, machining, etc.

Second frame 86 comprises cam profile 118. On a first end, cam profile 118 comprises cam surface 122 terminating to locking surface 120 at a second end. Locking surface 120 allows for the locking of blade guard 24 in the guarded position. When knife 10 is transitioning to the guarded position from the unguarded or cutting position, cam surface 122 allows for the automatic locking into the guarded position. This is made possible via the communication of second frame 86 to blade guard 24 that is described in detail below.

Figure 15:
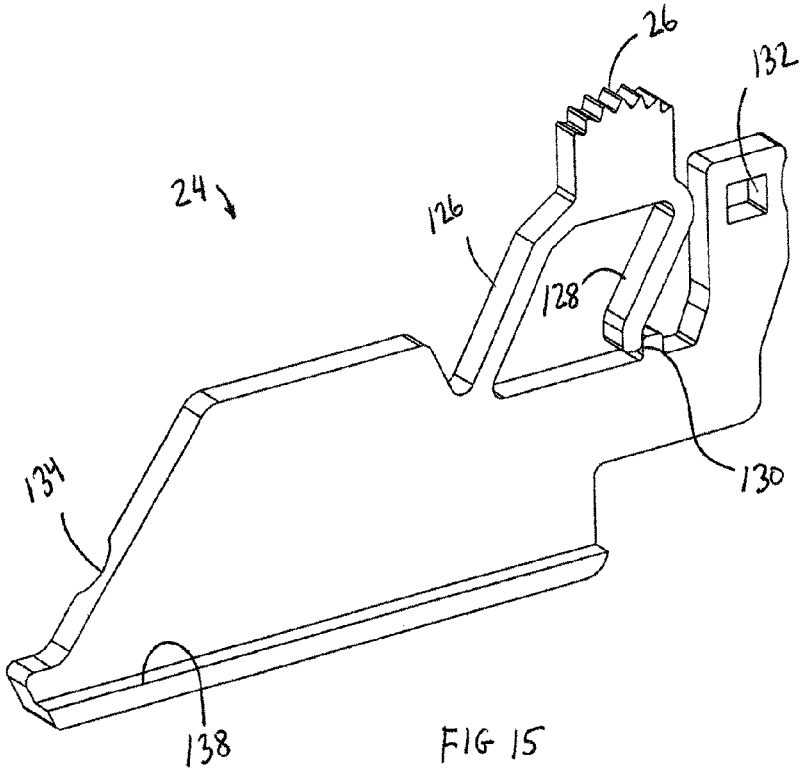
Figure 16:
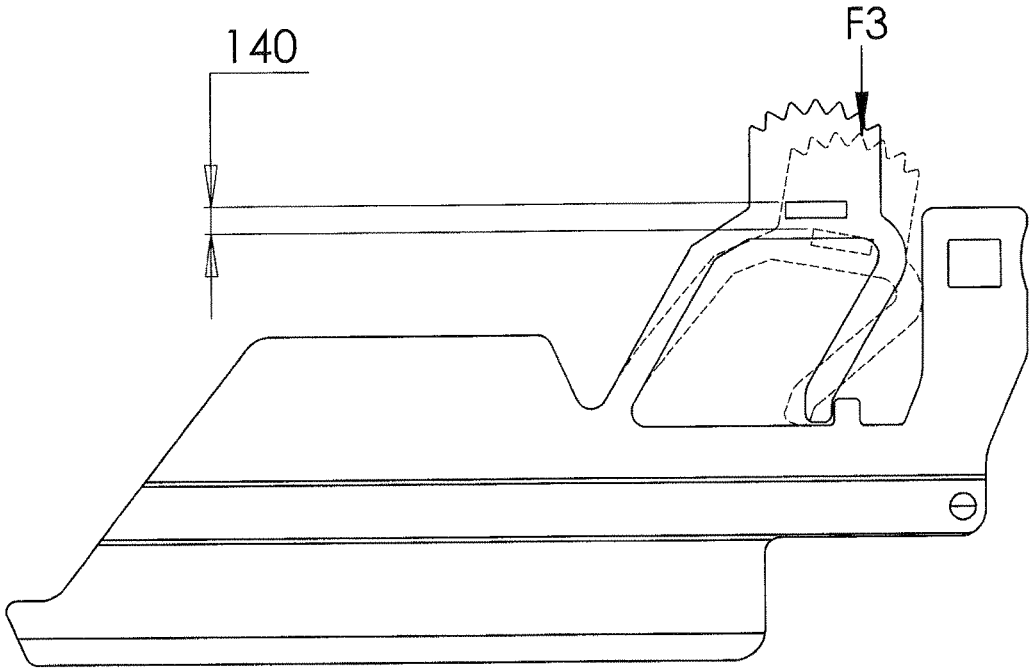
Figure 17:
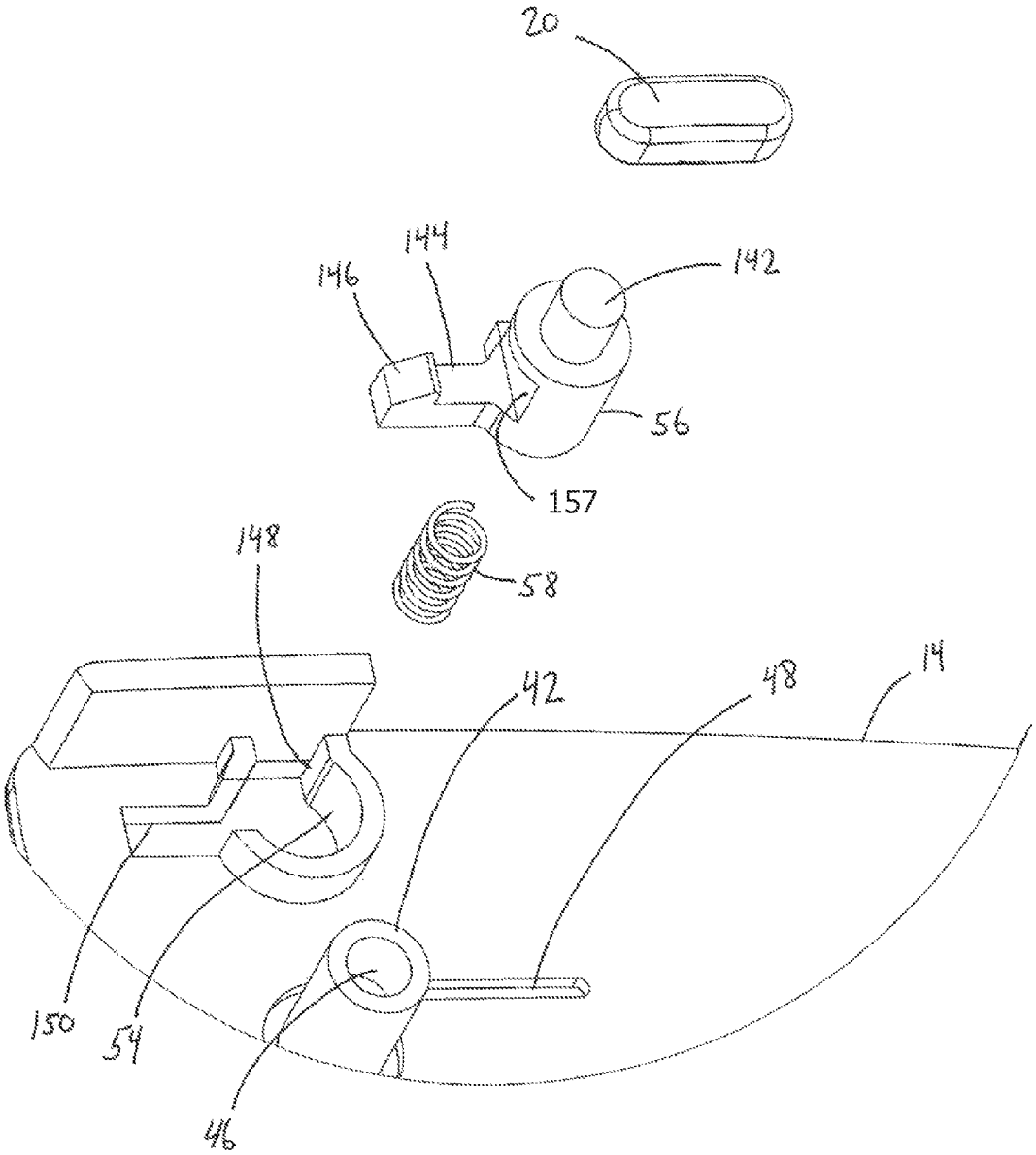
FIG. 17 is a partial exploded view of the cutting implement of FIG. 1.
Figure 18:
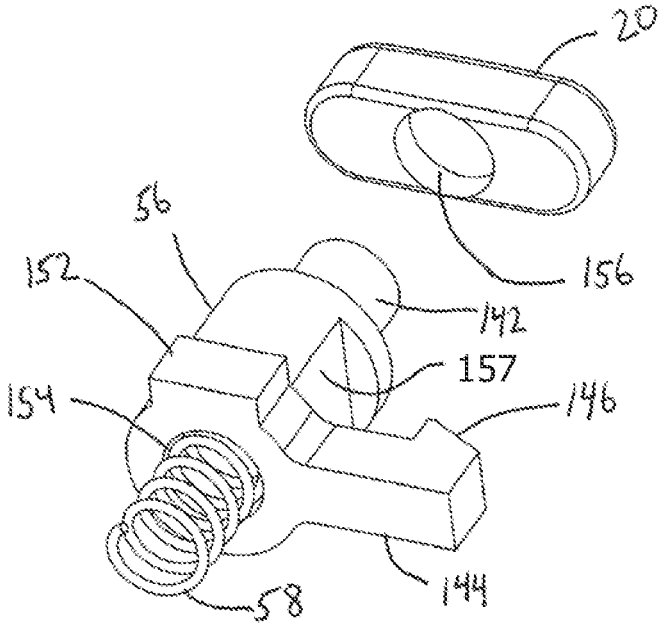
FIG. 18 is a partial exploded view of the cutting implement of FIG. 1.
Figure 19:
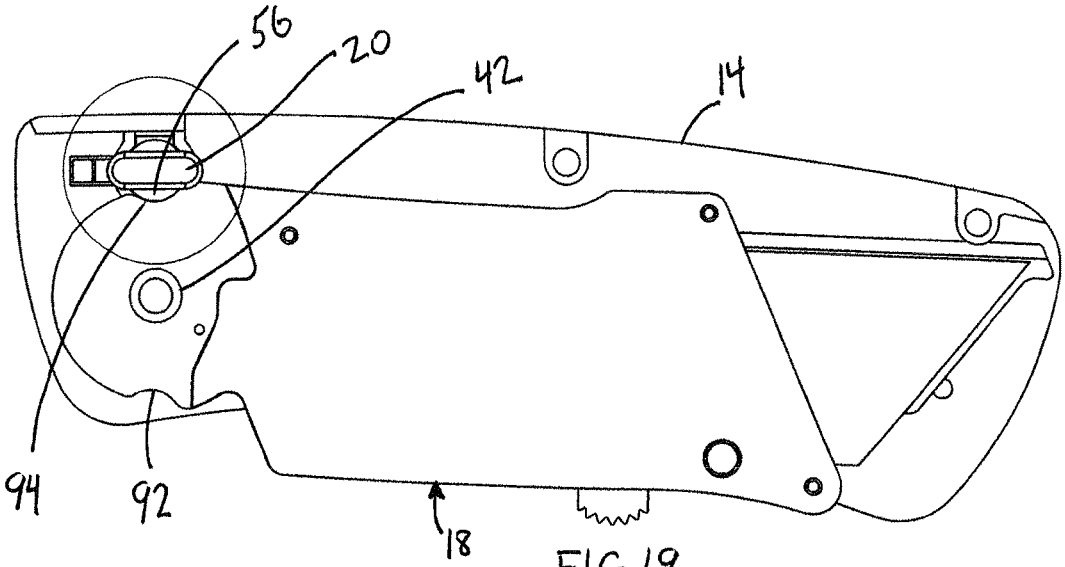
FIG. 19 is a side view of the cutting implement of FIG. 1 with various components removed illustrating the cutting implement in the locked closed position.

Blade guard 24 is described by simultaneous reference to FIGS. 13 through 16. For purposes of clarity, blade guard 24 is shown and described in three positions. The first being the manufactured position (FIGS. 13 & 14), the second being the functional position (FIG. 15), and the third being the flexed position (FIG. 16). In this example, blade guard 24 is formed of injection molded thermoplastic polymer in order to take advantage of the material properties. Of course it is contemplated that blade guard 24 can be processed utilizing other types of materials as well as other various manufacturing methods such as and not limited to thermo-set plastics i.e. reaction injection molding, plastic machining, die cut plastics, among others. In this example, blade guard 24 is formed of acetal polymer.

Blade guard 24 comprises a resilient member 126 and support member 128 wherein guard actuator 26 and locking member 124 are disposed therebetween. In the manufactured position, pillar 130 is positioned adjacent to support pillar 128 for fabrication purposes. Due to the plastic material properties, pillar 130 allows for the selective bending and repositioning of support member 128 to the functional position. This is illustrated in FIGS. 15 & 16 where support member 128 remains in contact with pillar 130. When support member 128 is repositioned in the functional position, resilient member 126 and support member 128 form an integral spring having a resilient force. When a user applies an actuation force F3 (FIG. 16) that is greater than the resilient force of the integral spring, resilient member 126 and support member 128 are flexed. This allows locking member 124 to translate distance 140 from its original position (FIG. 16). Locking member 124 returns back to its original state after the release of F3. This operation in combination with the interaction of locking member 124 to cam profile 118 provides the function of blade guard 24 that is described in detail below.

The selective repositioning of support member 128 to the functional position is dependent on the width and/or location of support pillar 130. In FIG. 15, support member 128 and resilient member 126 are shown to be substantially parallel to one another. This is by way of example. If support pillar 130 is increased in width, support member 128 can be selectively placed in the functional position at an alternate angle as compared to FIG. 15. This is also possible by altering the position of pillar 130. Thus one having skill in the art can appreciate that the alternate width and positions of pillar 130, or any combinations thereof, can allow multiple variations for the resilient force of the integral spring of blade guard 24.

In this example, blade guard 24 comprises an integral spring. However one having ordinary skill in the art can appreciate that blade guard 24 can be fabricated in two portions. The first portion can constitute the guard portion of blade guard 24 and the second portion can constitute the actuator portion. The two portions can be arranged so that the actuator portion is slidably or rotatably associated with each other and can further include a spring to provide the aforementioned resilient force for moving locking member 124. This would allow the choice of multiple materials for fabricating blade guard 24 including rigid not flexing materials such as metals, rigid plastics, etc.

Now referring back to FIG. 15. Blade guard 24 further comprises step 138. Step 138 is configured to cover the cutting edge (38) of blade 28 when knife 10 is in the first open (guarded) position. This is best seen in FIGS. 2 through 4. Blade guard 24 further comprises locking slot 132 located on one end. Locking slot 132 facilitates the locking of blade guard 24 in the second open (unguarded) position that is described in detail below.

Blade assembly 18 further includes a first locking surface 94 and a second locking surface 92. Adjacent to each locking surface are first offset 96 and second offset 90. First locking surface 94, second locking surface 92, first offset 96, and second offset 90 are located concentric to blade assembly bore 40 and spring bore 98 allowing for the pivoting and locking in the multiple positions that will is described in detail below.

Figure 22:
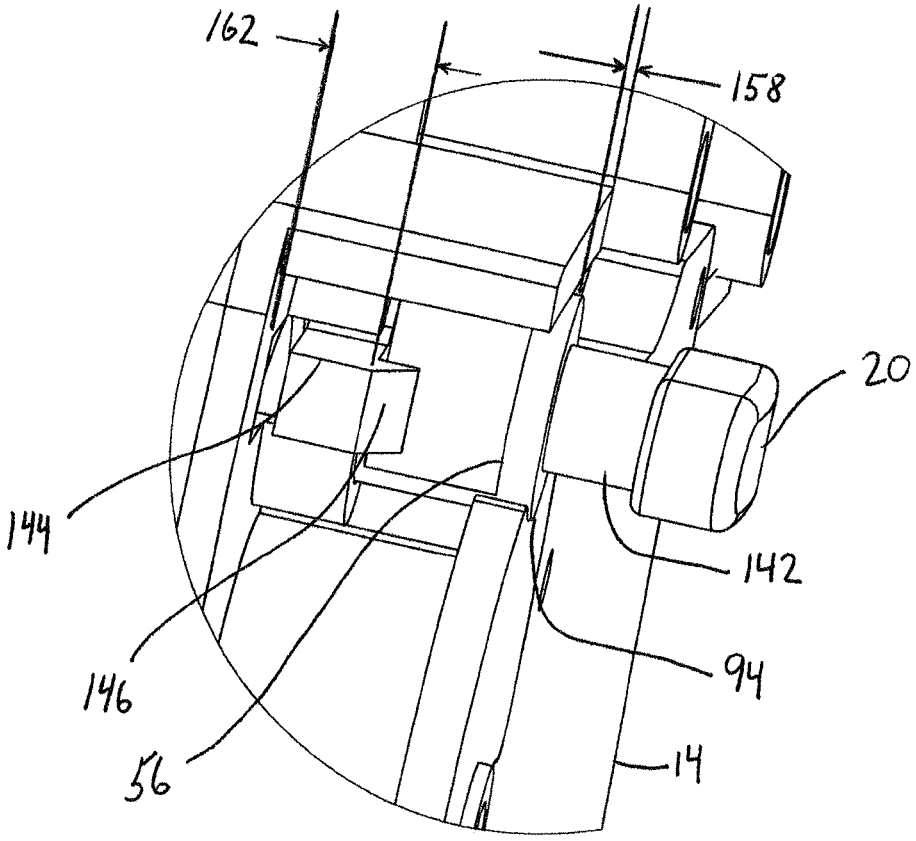
FIG. 22 is a detail view taken from FIG. 21.
Figure 23:
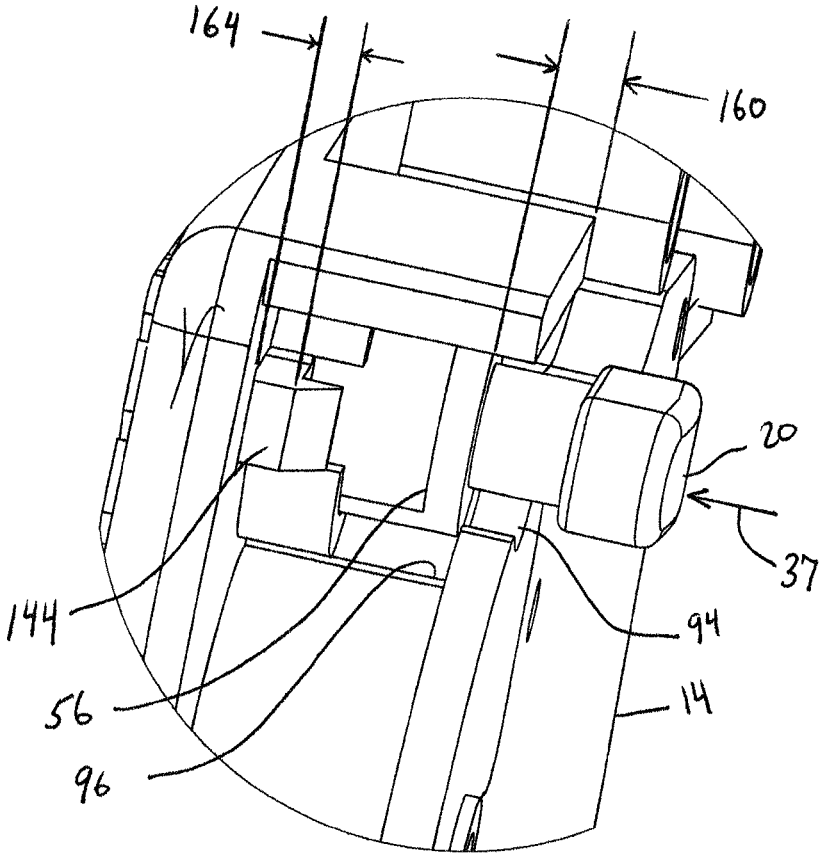
FIG. 23 is a detailed perspective view of the cutting implement of FIG. 1 illustrating the un-locking of the blade assembly.
Figure 24:
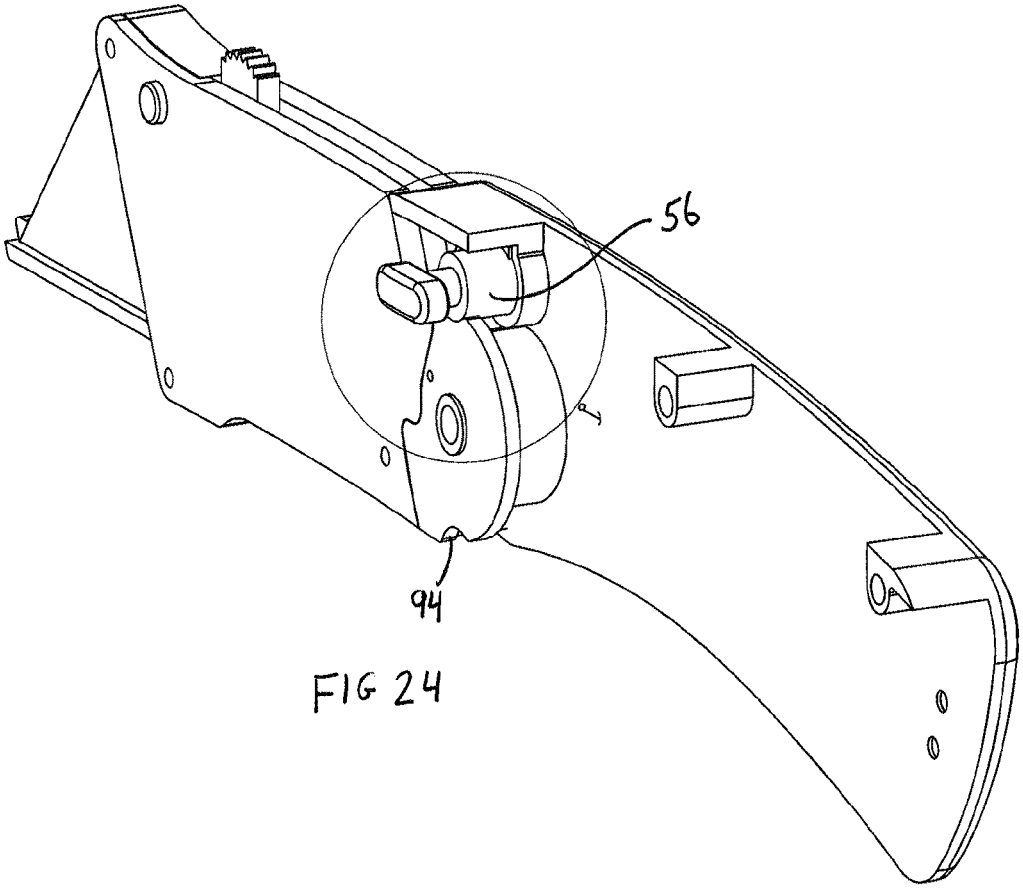
FIG. 24 is a perspective view of the cutting implement of FIG. 3 with various components removed illustrating the cutting implement in the first open (guarded) position.
Figure 25:
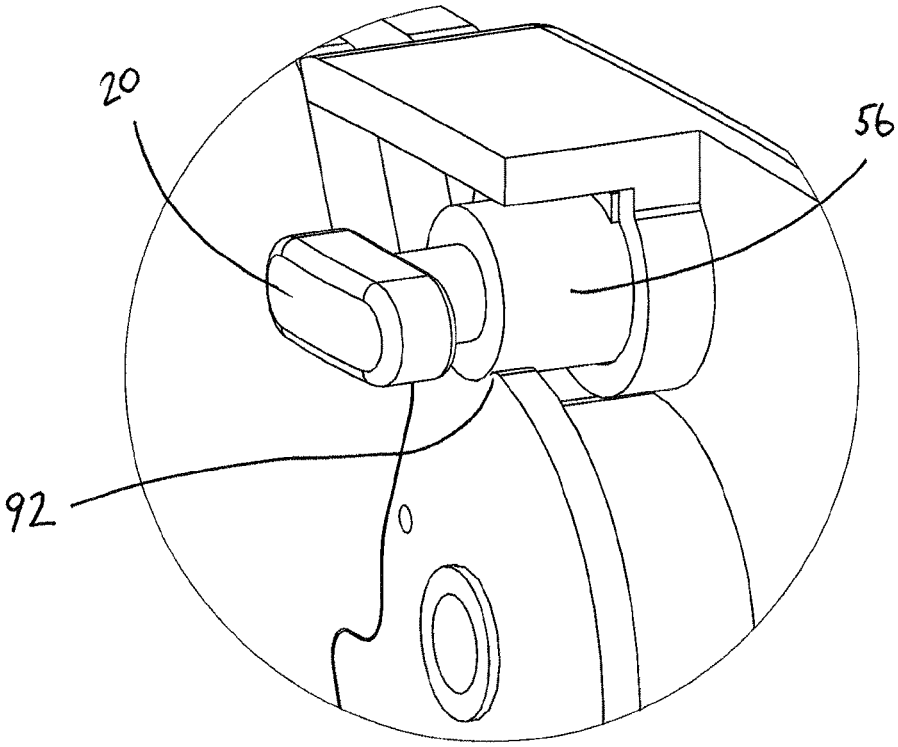
FIG. 25 is a detail view taken from FIG. 24.
Figure 26:
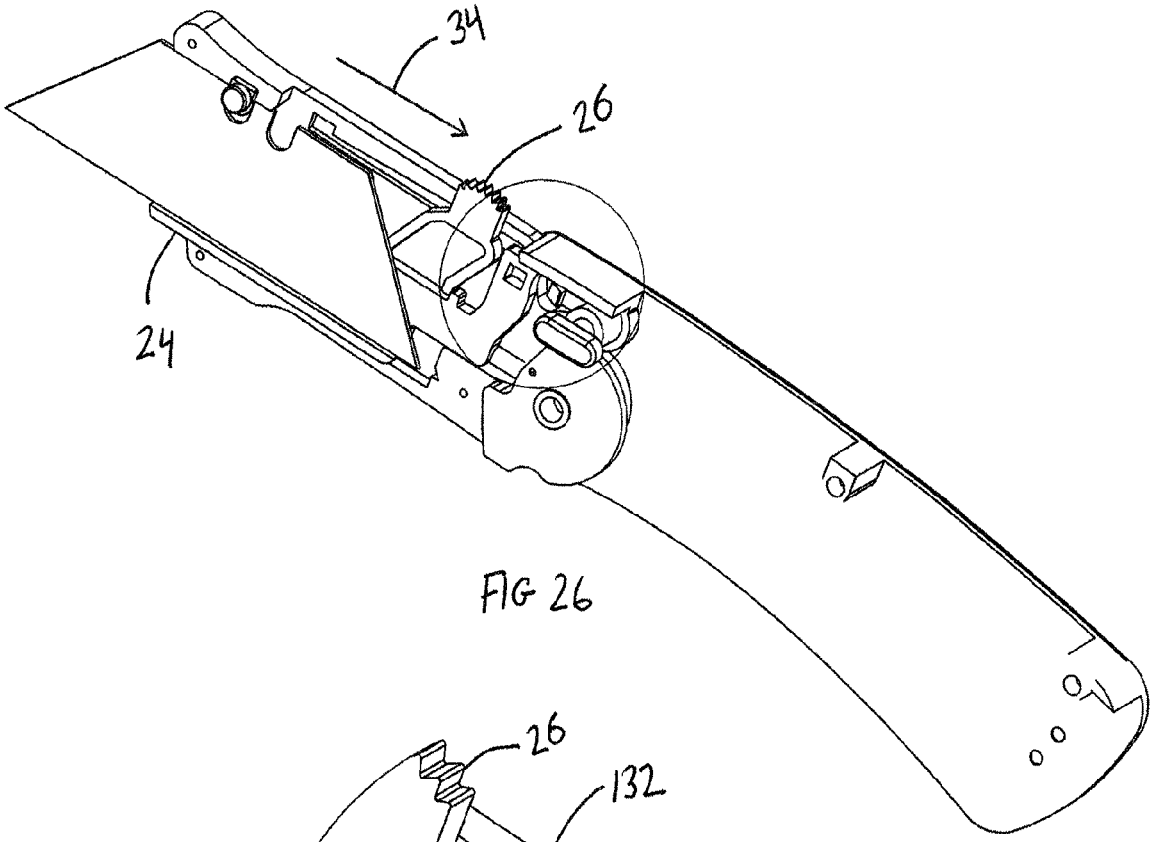
FIG. 26 is the cutting implement of FIG. 24 illustrating the transition into the second open (un-guarded or cutting) position.

The details of the operation of knife 10 will now be described. Knife 10 is illustrated in the locked closed position in FIGS. 19 through 22. As illustrated in FIG. 22, when knife 10 is locked in the closed position, distance 158 is formed utilizing a reference point from first housing member 14 to a reference point taken from locking member 56. This dimension is maintained via the urging force of locking member spring 58 described above. When distance 158 is maintained via locking member spring 58, locking member 56 is engaged with first locking surface 94 (contained on second frame 86 of blade assembly 18) maintaining knife 10 in the locked closed position. Knife 10 can then be automatically opened by depression of the actuator 20. As illustrated in FIG. 23, when actuator 20 is depressed by a user, locking member spring is compressed and locking member 56 translates to a distance 160 taken from the same reference points described above. This causes locking member 56 to disengage from first locking surface 94. First offset 96 provides the necessary clearance to locking member 56 so that aforementioned torsion spring 50 (FIGS. 7 & 8) allows the blade urging force F1 to automatically swing blade assembly 18 into the first open (guarded) position. When the user releases actuator 20 (before or after knife 10 transitions into the first (guarded) open position), knife 10 will lock in the first open position as illustrated in FIGS. 3, 4, 24, & 25. FIG. 25 illustrates locking member 56 engaged with second locking surface 92 locking knife 10 in the first open position.

When a cutting action is to be performed by knife 10, blade guard 24 can be selectively engaged by a user to uncover or expose cutting edge 38 of blade 28. In this example, moving blade guard 24 is achieved using a three step process. The first step involves the unlocking of blade guard 24. By simultaneous reference to FIGS. 35 through 38, blade guard 24 is configured to assemble onto second frame 86. Locking member 124 is configured to fit within cam profile 118. When blade guard 24 is in the guarded position, locking member 124 is engaged with locking surface 120. This prevents blade guard 24 from translating. To unlock the blade guard 24, the user depresses guard actuator 26 (FIG. 16) until distance 140 clears locking surface 120. While depressing guard actuator 26, the user can then move (step 2) blade guard along direction 34 (FIG. 5) opposing the force F2 from the aforementioned return spring 106. The third step is to lock blade guard 24 into the second open (guarded) position.

Figure 27:
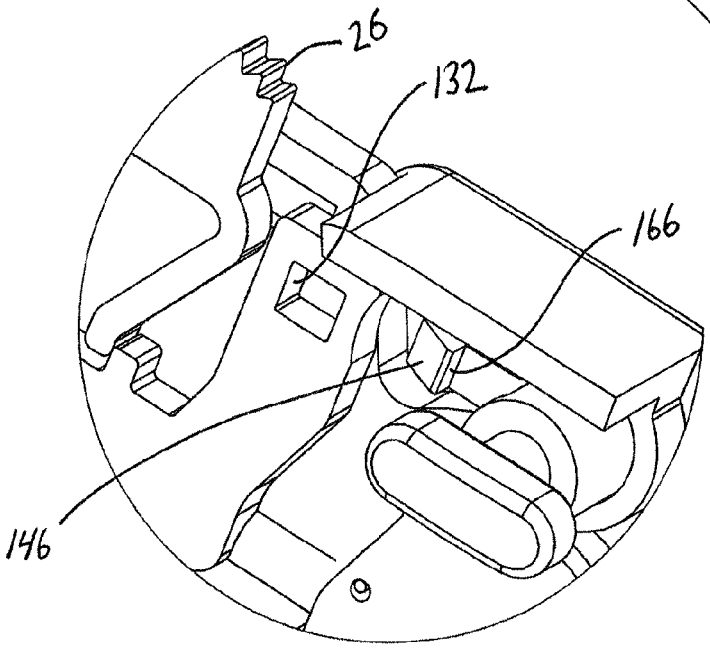
FIG. 27 is a detail view taken from FIG. 26.
Figure 28:
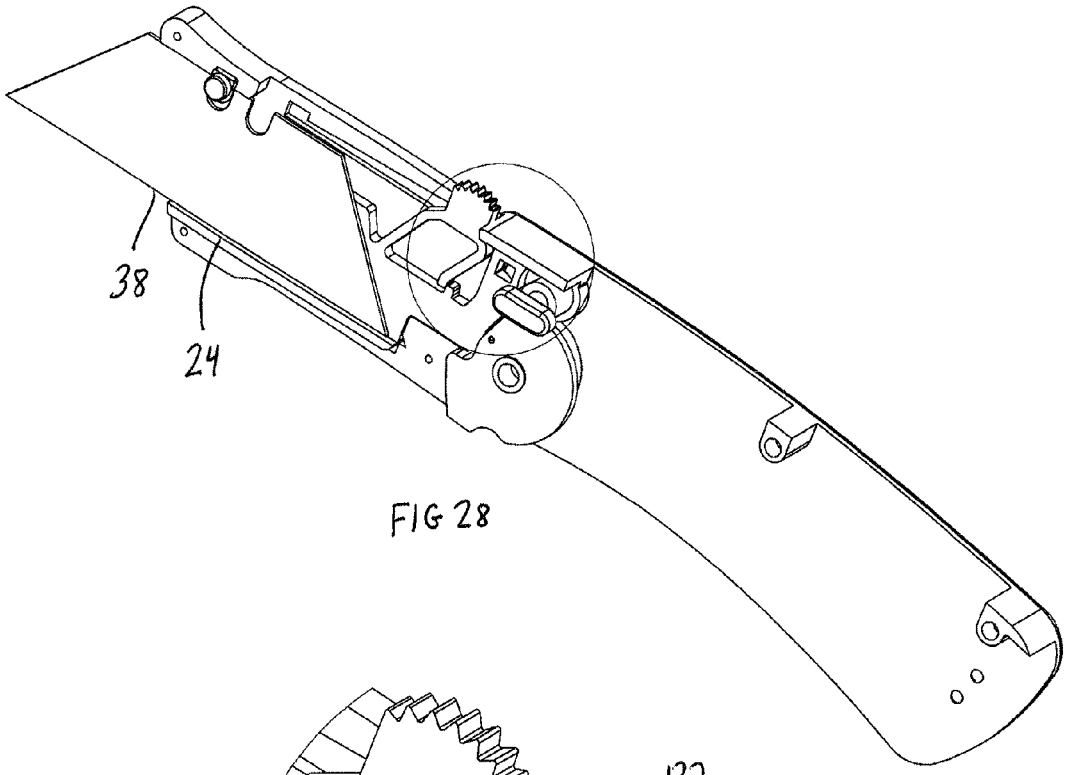
FIG. 28 is a perspective view of the cutting implement of FIG. 5 with various components removed illustrating the cutting implement in the second open (un-guarded or cutting) position.
Figure 29:
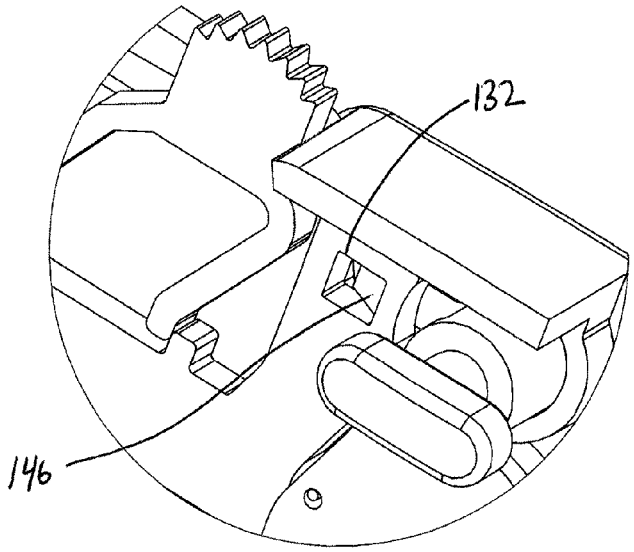
FIG. 29 is a detail view taken from FIG. 28.
Figure 30:
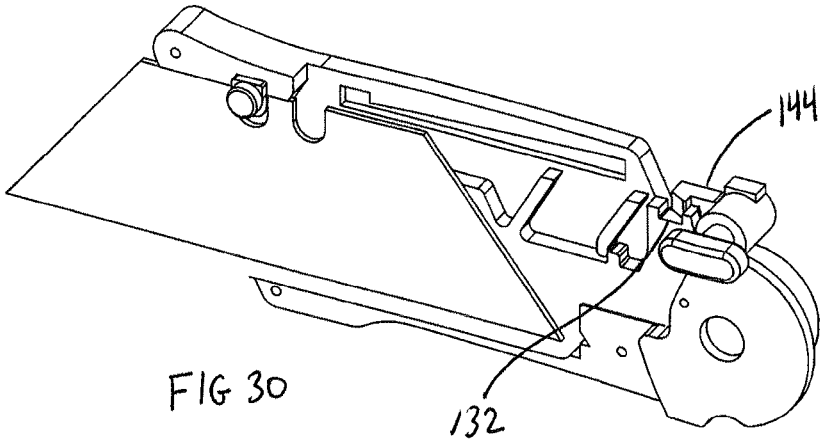
FIG. 30 is a partial cutout view taken from FIG. 28.
Figure 31:
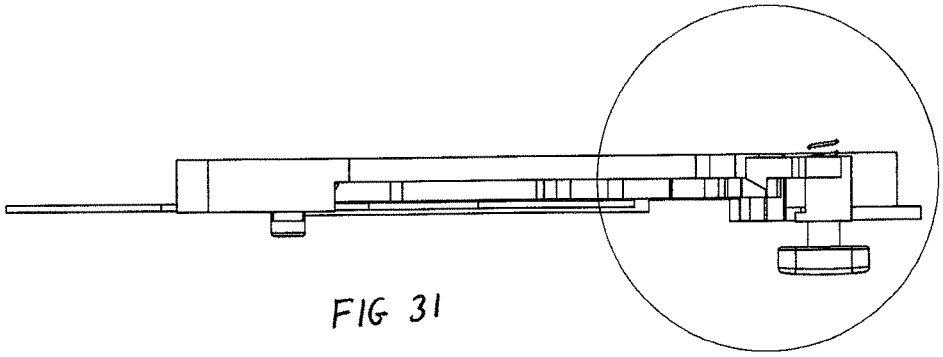
FIGS. 31 & 32 illustrate the top view of FIG. 30.
Figure 32:
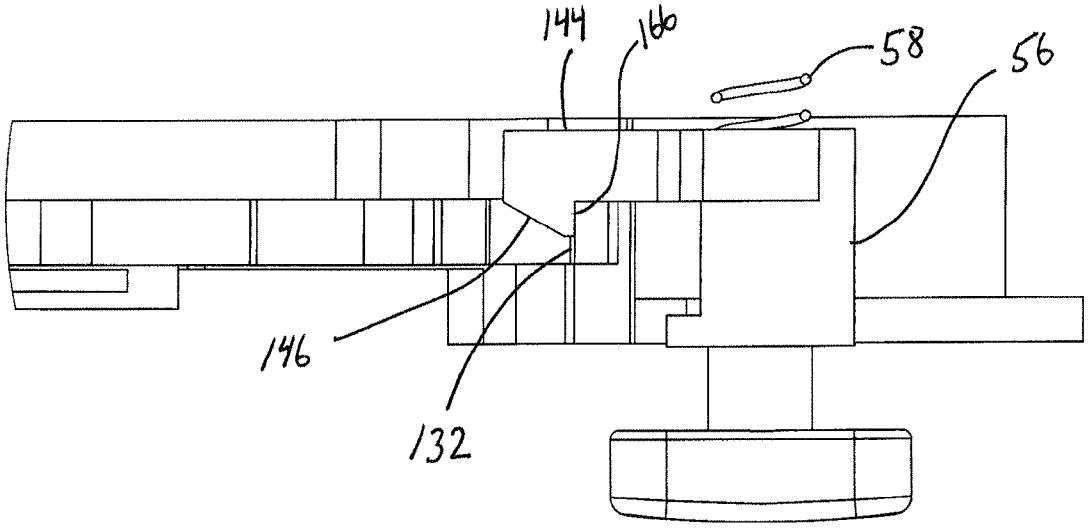

Locking of blade guard in the second open (guarded) position will be described by simultaneous reference to FIGS. 26 through 32. During transition to the second open (guarded) position by a user via interaction of guard actuator 26 along direction 34 (FIGS. 26 & 27), blade guard 24 approaches lead in surface 146 on locking tab 166 located on locking member 56. As illustrated in FIG. 27, blade guard 24 will contact lead in surface 146 in transition to the second open (guarded) position. The contact of blade guard 24 to lead in surface 146 will cause locking arm 144 to translate via a cam action. This will cause locking member 56 to compress locking member spring 58 as blade guard is transitioning into the second open (guarded) position. When blade guard 24 is in the second open (guarded) position, locking tab 166 will be forced into locking slot 132 by locking member spring 58. This will lock blade guard 24 in the second open (un-guarded) position and allows for a cutting action by a user. FIGS. 30 through 32 illustrate a cutout view of blade guard 24 when locked in the second open (guarded) position.

It has been determined by this disclosure that this operation provides enhanced safety when knife 10 is left unattended. If knife 10 is discovered by a child, the three step process necessary for exposing cutting edge 38 may overcome the cognitive ability of the child.

When it is desired to place knife 10 in the locked closed position as shown in FIG. 1, the user simply depresses actuator 20. When closing knife 10, actuator 20 serves a dual purpose. By depressing actuator 20, both locking arm 144 and locking member 56 move from a locking position to an unlocking position. By referring back to FIG. 22, when actuator 20 is the natural position (not depressed), distance 162 and 158 are shown to describe actuator 20 in a locking position. These positions are substantially similar when blade assembly 18 is either in the locked closed or locked open position. FIG. 23 illustrates actuator 20 in the unlocked position via distances 164 and 160 when actuator 20 is depressed along direction 37. Distance 160 illustrates the movement of locking member 56 and distance 164 illustrates the movement of locking arm 144.

Figure 33:
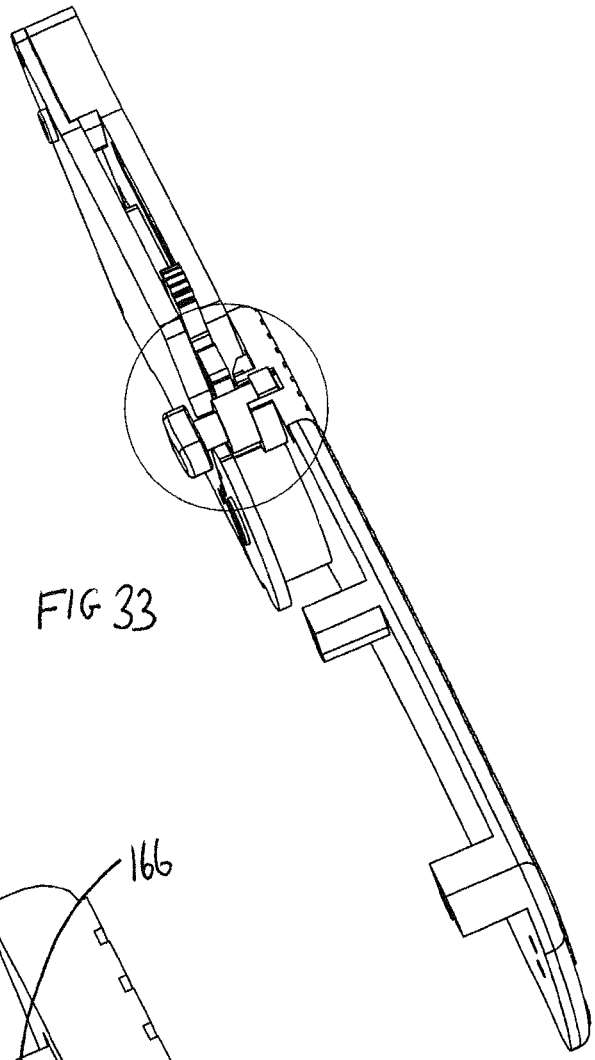
FIG. 33 is a perspective view of the cutting implement as shown in FIG. 28 illustrating the un-locking of the blade assembly.
Figure 34:
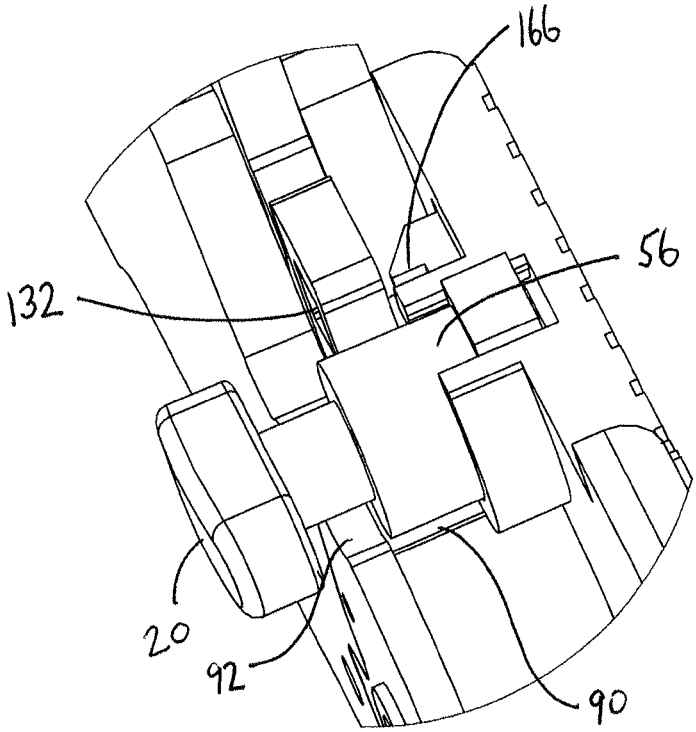
FIG. 34 is a detail view taken from FIG. 33.
Figure 35:
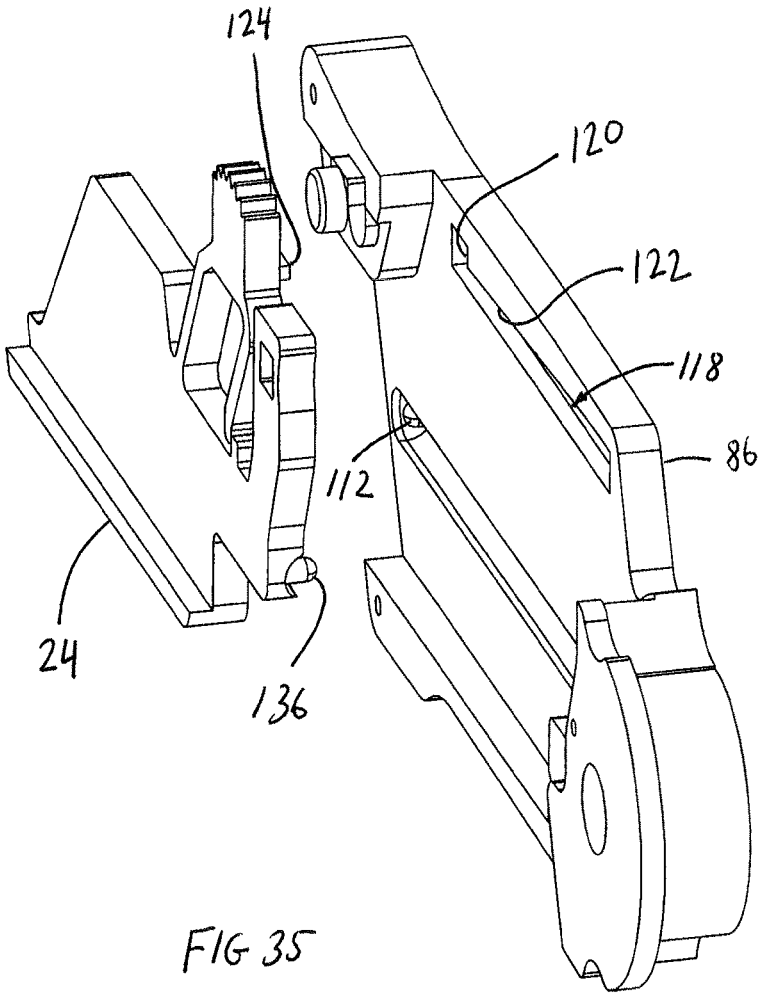
FIG. 35 is a partial exploded view of the blade assembly as shown in FIG. 11.

Now referring to FIGS. 33 & 34, actuator 20 is shown in the depressed position where locking member 56 and locking arm 144 are both in the unlocking position. Distances 164 and 160 are not shown for purposes of clarity. When locking arm 144 moves to the unlocking position, locking tab 166 clears locking slot 132 as shown. The instant locking tab 166 clears locking slot 132, blade guard 24 will automatically move to the blade guarded position via return spring 106. This action provides an instant covering of the cutting edge 38 by step 138 prior to the closing of blade assembly 18. As further illustrated by FIG. 34, when actuator 20 is in the unlocking position, locking member 56 is also disengaged from second locking surface 92 into second offset 90. This allows the user to manually close blade assembly 18 to the locked closed position as illustrated in FIG. 1.

It has been determined by this disclosure that this operation provides enhanced safety for a user and is evident that the cutting edge 38 of the blade 28 is covered during the closing of knife 10. In addition, when blade assembly 18 is moved to the locked closed position, the user must overcome torsion spring 50. Torsion spring 50 provides a constant restoring force to the open position which ensures that blade assembly 18 will not automatically accelerate to the locked closed position. This provides an added margin of safety if blade guard 24 should become inoperable by damage or tampering.

As stated above, knife 10 is configured to accept disposable blades. Many disposable blades are trapezoidal (blade 28) in shape and have two cutting edges 38 as illustrated in the drawing figures. When the blade 28 is worn, the user can remove blade 28 and reverse or replace the blade when the cutting edge becomes dull. However, one having skill in the art can appreciate that knife 10 is also suitable for use with a permanent blade. Such permanent blade can be fabricated in any desired size and shape and knife 10 can be configured to operate in the same manor as detailed herein.

Figure 41:
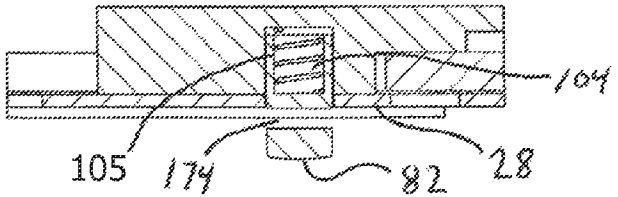
Figure 39:
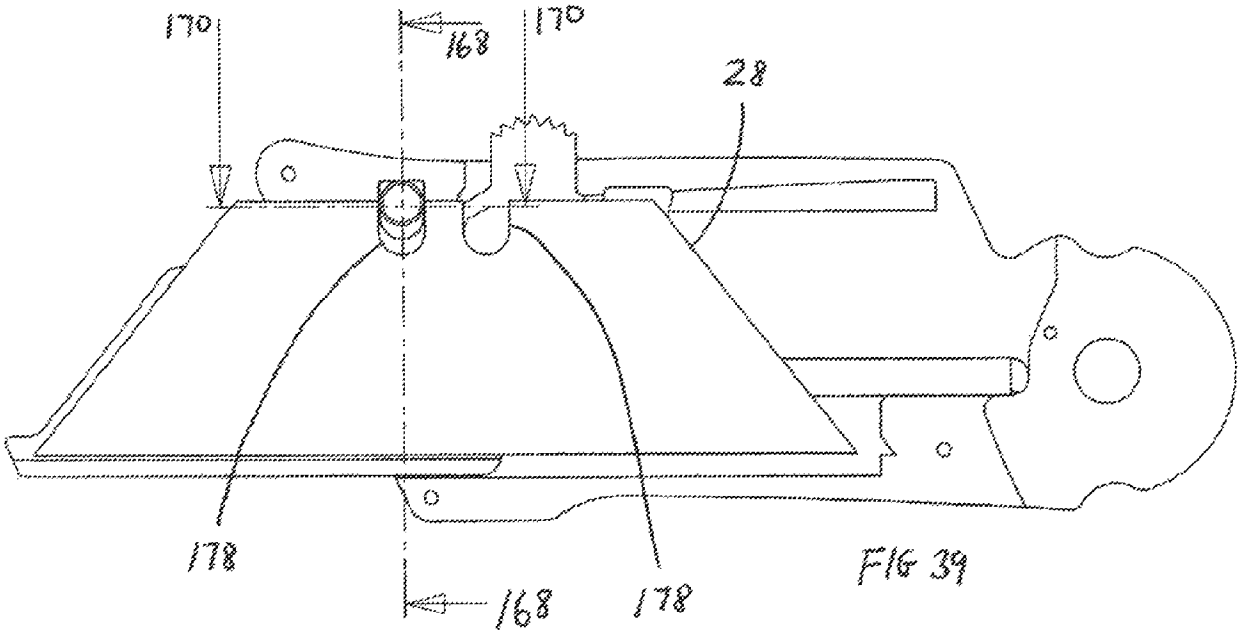
Figure 40:
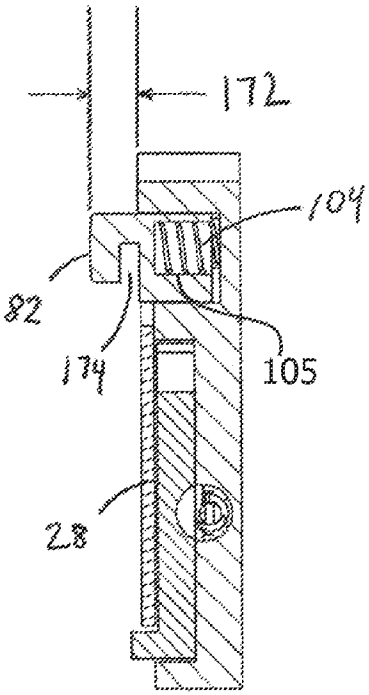
Figure 42:
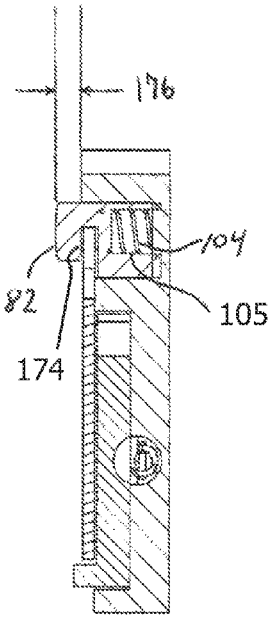

Locking of blade 28 will be described by simultaneous reference to FIGS. 39 to 41. Blade 28 has one or more slots 178 that allow release member 82 to protrude therethrough. On the opposite side of release member 82 is bore 105 to allow release spring 104 to be assembled therein. Release spring 104 provides the necessary force to retain blade 28 to blade assembly 18. Contained within release member 82 is slot 174. When release member is in the locked state, slot 174 is out of alignment with blade 28 as illustrated by distance 172. This allows the outer surface of release member 82 to retain blade 28 via slot 178.

Figure 44:
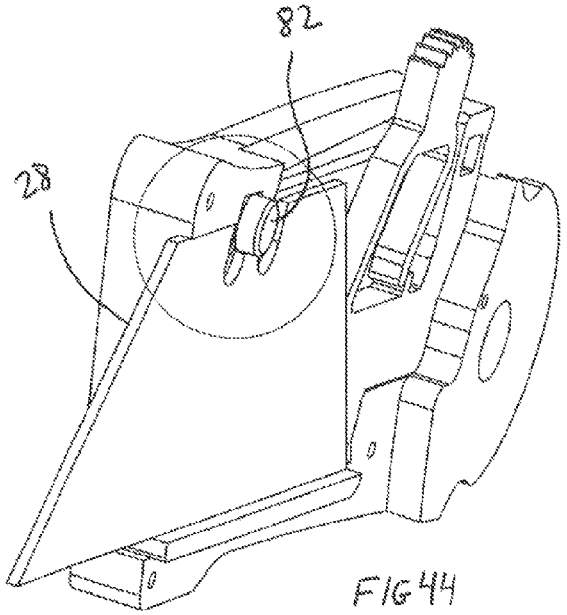
Figure 43:
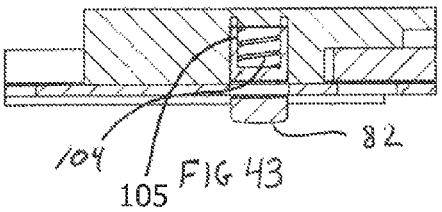
Figure 45:
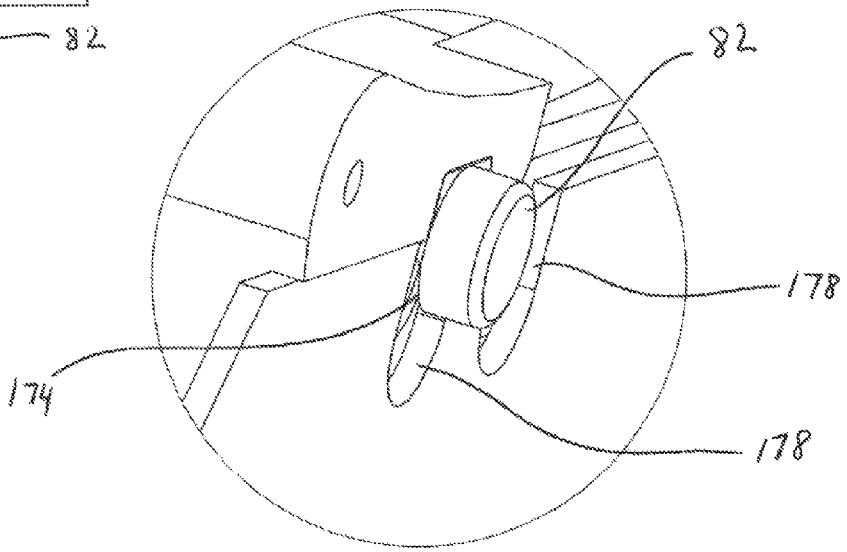
Figure 46:
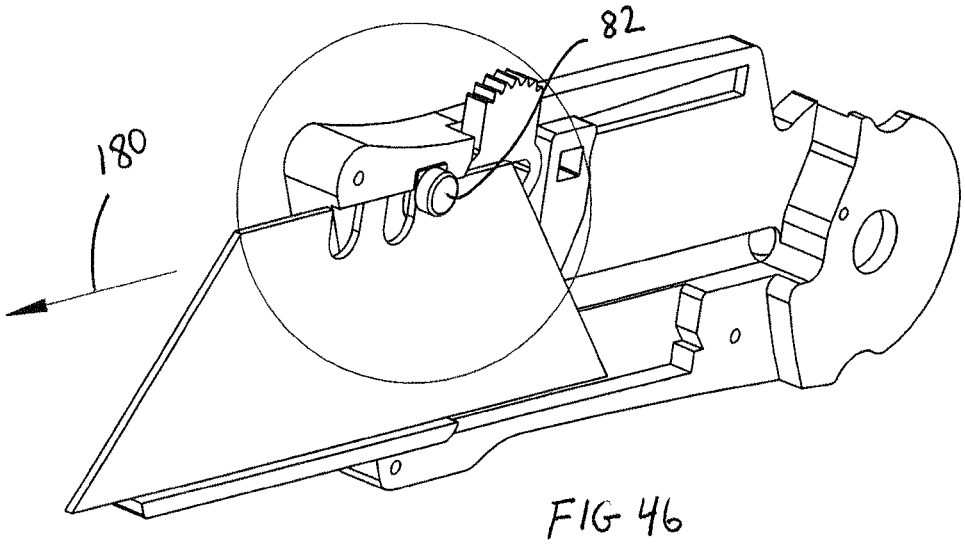
Figure 47:
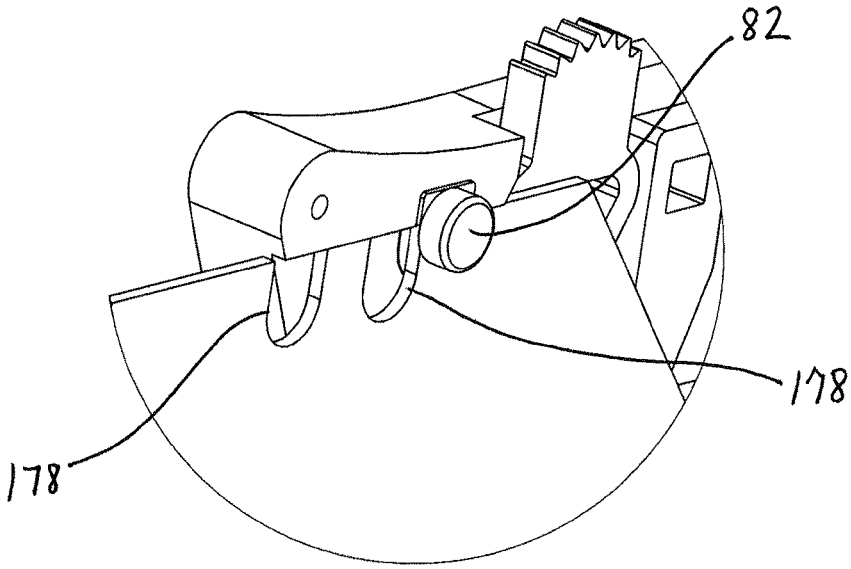

Removal of blade 28 will be described by simultaneous reference to FIGS. 42 to 47. Upon selective depression of release member 82, release spring compresses and slot 174 moves to an unlocking position as shown via distance 176. In the unlocked state, slot 174 is substantially aligned to blade 28 creating a path for blade 28 to move therethrough. FIGS. 44 & 45 illustrate the depression of release member 82 where slot 174 is substantially aligned with blade 28. Blade 28 can then be removed by a pulling action by a user. FIGS. 46 and 47 illustrate the blade being removed by a pulling action along direction 180. The reinsertion of blade 28 can be accomplished via a reversal of the above.

It should also be noted that the terms "first", "second", "third", "upper", "lower", and the like may be used herein to modify various elements. These modifiers do not imply a spatial, sequential, or hierarchical order to the modified elements unless specifically stated.

While the present disclosure has been described with reference to one or more exemplary embodiments, it will be understood by those skilled in the art that various changes may be made and equivalents may be substituted for elements thereof without departing from the scope of the present disclosure. In addition, many modifications may be made to adapt a particular situation or material to the teachings of the disclosure without departing from the scope thereof. Furthermore, it should be understood that there is no intention to limit this disclosure to specific forms disclosed, but on the contrary, the intention is to cover all modifications, alternative constructions, and the equivalents falling within the spirit and scope of this disclosure. Therefore, it is intended that the present disclosure not be limited to the particular embodiment(s) disclosed as the best mode contemplated, but that the disclosure will include all embodiments falling within the scope of the disclosure.

It should be noted that the various features as described by reference to knife 10 can be selectively combined, and/or altered, and/or excluded to create different products. For example, by removing the locking member on the blade guard, the blade guard can be moved and locked to a second open position in a single operation (i.e. no depression of the guard actuator).

Other examples are possible including and not limited to those listed below:

a) One example of an altered construction includes the blade contained in a guarded position (first open position) within the blade assembly. In this example, the blade assembly is configured to allow a user to extend the blade from within the blade assembly to a second open or cutting position via the selective operation of a blade actuator.

b) Another example is described by way of the selective exclusion of the torsion spring. In this example, the user unlocks the blade assembly via depression of the actuator and grasps a portion of blade the assembly. This allows the manual rotation of the blade assembly to a first open position. In this example, the exclusion of the torsion spring allows the manual operation of opening the blade assembly to the first open locked position from a locked closed position. The closing of the knife is achieved by the selective depression of the actuator where the user can manually close the blade assembly to the locked closed position. In this example, the user does not have to overcome a torsion spring as described with reference to knife 10.

c) Another example excludes a structure to lock the blade guard in a second open (unguarded) position. In this example, after the blade assembly is opened to the first open position via selective depression of the actuator, the blade guard can be biased to uncover the cutting edge of the blade by overcoming a return spring as detailed above. The user is required to manually retain the blade guard in the open position until contact with a work piece for performing a cutting action. This contact will allow the blade edge to remain exposed and in contact with the work piece until the cutting action is complete. When the cutting action is complete, the return spring will cause the blade guard to automatically transition back to the blade guarded position. This process can be repeated for subsequent cutting actions.

d) In yet another example, the embodiments as described above the blade assembly can be altered for a fixed assembly to the housing of the knife. This can result in the creation of a straight (non-folding) knife having a blade guard normally covering the edged of the blade via a return spring. The blade assembly can have substantially a similar three step process for unlocking the blade guard (as detailed above) so that the knife can be locked in the un-guarded (cutting) position through a selective action of a guard actuator.

The invention claimed is:

1. A folding knife for applying a cutting action, comprising:

a handle;

a blade assembly rotatably mounted to the handle and rotatable between an open position and a closed position within the handle;

a locking member arranged on the handle adapted to maintain the blade assembly in said closed position or in said open position;

a first spring biasing said blade assembly toward said open position;

a first actuator adapted to release the blade assembly from the locking member and from said closed position to permit said blade assembly to rotate to said open position;

a cutting blade removably mounted to the blade assembly; and a blade guard that is slidingly engaged with the blade assembly and includes a second actuator for moving the blade guard from a first position, shielding the blade, to a second position where the blade guard is withdrawn from the blade and held at the second position by the locking member, wherein, when the blade assembly is in the open position, the first actuator is adaptable to release the blade guard from the locking member so that the blade guard shifts from the second position to the first position and the first actuator is adaptable to release the blade assembly to permit rotation of the blade assembly from the open position to the closed position within the handle.

2. A folding knife as set forth in claim 1, wherein the blade assembly is maintained substantially within the handle in the closed position.

3. A folding knife as set forth in claim 1, wherein said first actuator is integrated with said handle.

4. The folding knife as set forth in claim 1, further comprising a second spring biasing the blade guard toward the first position.

5. A folding knife, comprising:

a handle;

a blade assembly rotatably mounted to the handle assembly and rotatable between an open position and a closed position within the handle;

a first spring biasing said blade assembly toward said open position;

a locking member arranged on the handle assembly for releasably locking the blade assembly in said closed position or in the open position;

a first actuator in connection with said locking member adapted to release the blade assembly from the closed position and permit said blade assembly to rotate to said open position; and a blade guard slidingly engaged with said blade assembly including a second actuator for moving the blade guard between a first, extended position and a second, withdrawn position with said first actuator holding said blade guard in the withdrawn position, wherein, when said blade assembly is moved from said open position to said closed position, said first actuator is adapted to release said blade guard and permit said blade guard to move from said withdrawn position to said extended position and said first actuator is adapted to release the blade assembly from the open position and permit the blade assembly to rotate to the closed position.

6. A folding utility knife, comprising:

a handle;

a locking member arranged within said handle;

a blade carrier rotatably engaged with said handle and rotatable between a closed position and an open position, said blade carrier including a first locking surface interacting with said locking member to releasably maintain said blade carrier a closed position and a second locking surface adapted to releasably maintain said blade carrier in said open position;

a blade removably mounted to the blade carrier;

a first actuator adapted to release said blade carrier from said locking member and permit said blade carrier to rotate to said open position and from said open position to said closed position; and a blade guard mounted to said blade carrier, said blade guard including a second actuator for sliding said blade guard between an extended, guarded position and a retracted, unguarded position, said locking member holding said blade guard at the second position, wherein, when said blade carrier is moved from said open position to said closed position, said first actuator is adapted to release said blade guard from said locking member and said blade guard is adapted to shift from said refracted, unguarded position to said extended, guarded position.

7. The folding utility knife of claim 6, wherein, in said closed position, the blade is maintained substantially within the handle.

8. A folding knife, comprising:

a handle;

a blade assembly rotatably mounted to the handle and rotatable between an open position and a closed position within the handle;

a locking element arranged within said handle, maintaining the blade assembly in said closed position or in said open position;

a first spring member biasing said blade assembly toward said open position;

a first actuator adapted to release the blade assembly from said closed position and permit said blade assembly to rotate toward said open position;

a cutting blade releasably fixed to the blade assembly;

a blade guard slidingly engaged with the blade assembly and including a second actuator for moving the blade guard between a first, guarded position and a second, unguarded position; and a blade lock adaptable to releasably fix said blade guard in said second, unguarded position.

* * * * *